US010648157B2

(12) United States Patent
Hewitt

(10) Patent No.: US 10,648,157 B2
(45) Date of Patent: May 12, 2020

(54) HYDRAULIC SYSTEMS FOR CONSTRUCTION MACHINERY

(71) Applicant: J.C. BAMFORD EXCAVATORS LIMITED, Uttoxeter (GB)

(72) Inventor: James Hewitt, Leicestershire (GB)

(73) Assignee: J.C. BAMFORD EXCAVATORS LIMITED, Uttoxeter, Staffordshire (GB)

( * ) Notice: Subject to any disclaimer, the term of this patent is extended or adjusted under 35 U.S.C. 154(b) by 0 days.

(21) Appl. No.: 15/722,812

(22) Filed: Oct. 2, 2017

(65) Prior Publication Data

US 2018/0119389 A1 May 3, 2018

(30) Foreign Application Priority Data

Oct. 3, 2016 (GB) ..... 1616799.1

(51) Int. Cl.
*F15B 11/17* (2006.01)
*E02F 9/22* (2006.01)

(52) U.S. Cl.
CPC ..... *E02F 9/2232* (2013.01); *E02F 9/2203* (2013.01); *E02F 9/2242* (2013.01); *E02F 9/2267* (2013.01); *E02F 9/2289* (2013.01); *E02F 9/2292* (2013.01); *E02F 9/2296* (2013.01); *F15B 11/17* (2013.01); *F15B 2211/20561* (2013.01); *F15B 2211/20576* (2013.01); *F15B 2211/27* (2013.01);
(Continued)

(58) Field of Classification Search
CPC ..... E02F 9/2232; E02F 9/2239; E02F 9/2267; F15B 11/17; F15B 2211/3059
See application file for complete search history.

(56) References Cited

U.S. PATENT DOCUMENTS 8,910,474 B2 * 12/2014 Knussman ..... E02F 9/2242 60/421
2010/0043420 A1 2/2010 Ikeda et al.
(Continued)

FOREIGN PATENT DOCUMENTS

CN 104040082 A 9/2014
CN 104903595 A 9/2015
CN 105917053 A 8/2016
(Continued)

OTHER PUBLICATIONS

Search Report for GB 1616799.1, dated Mar. 17, 2017.
(Continued)

*Primary Examiner* — Michael Leslie
*Assistant Examiner* — Daniel S Collins
(74) *Attorney, Agent, or Firm* — Marshall, Gerstein & Borun LLP

(57) ABSTRACT

The present invention relates to a hydraulic system comprising a first actuator, a first variable displacement pump fluidly connected to the first actuator via a first circuit and adapted to drive the first actuator. The system further comprises a second actuator and a second pump fluidly connectable to the second actuator via a second circuit and adapted to drive the second actuator, wherein the second pump is fluidly connectable to the first actuator via a first control valve, and wherein the second pump is fluidly connectable to the second actuator via a second control valve.

20 Claims, 12 Drawing Sheets

(52) U.S. Cl.
CPC ..... *F15B 2211/30595* (2013.01); *F15B 2211/6654* (2013.01); *F15B 2211/7142* (2013.01)

(56) References Cited

U.S. PATENT DOCUMENTS

| | | | |
|---|---|---|---|
| 2013/0098015 | A1 | 4/2013 | Opdenbosch |
| 2016/0208459 | A1 | 7/2016 | Takahashi |

FOREIGN PATENT DOCUMENTS

| | | | |
|---|---|---|---|
| EP | 1 571 352 | A1 | 9/2005 |
| WO | WO-2013/059386 | A1 | 4/2013 |
| WO | WO-2013/059540 | A1 | 4/2013 |

OTHER PUBLICATIONS

Extended European Search Report issued in European Patent Application No. 17194458, dated Mar. 19, 2018.
Office Action issued in Chinese Patent Application No. 2017109303395, dated Dec. 20. 2019.
Office Action issued in Chinese Patent Application No. 201710931618.3, dated Dec. 23, 2019.

* cited by examiner

HYDRAULIC SYSTEMS FOR CONSTRUCTION MACHINERY

FIELD OF THE INVENTION

The present invention relates to hydraulic systems, particularly hydraulic systems for construction machinery such as excavators. The invention further relates to construction machinery comprising the hydraulic system.

BACKGROUND OF THE INVENTION

A variety of different hydraulic systems for construction machinery are known in the art. The hydraulic systems comprise several hydraulic actuators receiving a supply of pressurized fluid for actuating moveable members of the machinery, such as swing drives, booms, dippers, buckets, travel motors and other moveable parts of the respective construction machinery. In traditional hydraulic systems, depending on the size of construction machinery, one or more largely sized displacement pump/s is/are used to supply pressurized hydraulic fluid to all of the actuators of the respective machinery. To this end, the hydraulic displacement pump/s is/are each connected to several actuators by means of directional control valves, which connect the outlet port of the pump/s to all of the hydraulic actuators. The output flow of the hydraulic pump/s is therefore distributed between several actuators by means of proportional control valves. These so-called metering systems cause throttling of the flow through the control valves and are known to waste energy as a consequence.

SUMMARY OF THE INVENTION

In more recent developments, an alternative type of hydraulic system, which is known as a displacement controlled system or a meterless hydraulic system, was investigated in view of increased energy efficiency. Displacement controlled hydraulic systems comprise a plurality of hydraulic pumps, each of which is connected to a single actuator. The hydraulic pumps of displacement control systems are usually variable displacement pumps to selectively adjust the flow of pressurized fluid provided by the pump to its respective actuator. For example, to move an actuator at high speed, the flow of the respective pump is increased, while the flow is decreased if slower actuation of the actuator is required. Displacement controlled hydraulic systems are known to be more energy efficient than metering systems because the amount of flow directed to the actuators is controlled through variation of the pump output flow rather than restricting flow with proportional metering valves. In other words, the pumps of a displacement controlled hydraulic system are regulated to only discharge hydraulic fluid at a flow rate and pressure necessary to move the actuators at the desired speed and force, and therefore do not incur energy losses through throttling of the fluid flow or reducing the pressure.

While displacement controlled hydraulic systems show significant improvements in energy efficiency, it was found that they are not commercially viable for utilization in construction machinery, such as excavators. This is because known displacement controlled systems usually require the individual displacement pumps to be of large size in order to move the actuators at the desired speed (in excavators this speed is determined by the so-called cycle time needed to fully extend and retract an actuator in air). Implementing a plurality of largely sized pumps (one per actuator), however, significantly increases the manufacturing cost of displacement controlled system. Moreover, it is a known problem that large hydraulic pumps exhibit poor energy efficiency, when being operated at a reduced output flow rate, that is, if actuators are moved at slower speeds.

In view of the above, it is an object of the present invention to provide a hydraulic system that exhibits high fuel efficiency under high and low load/speed conditions. It is a further object of the invention to reduce manufacturing costs and improve energy efficiency compared to conventional displacement controlled hydraulic systems.

In a first embodiment, the invention relates to a hydraulic system comprising a first actuator and a first variable displacement pump fluidly connected to the first actuator via a first circuit and adapted to drive the first actuator. The system further comprises a second actuator and a second pump fluidly connectable to the second actuator via a second circuit and adapted to drive the second actuator. The second pump is fluidly connectable to the first actuator via a first control valve and to the second actuator via a second control valve.

In simple terms, the hydraulic system of the present invention is a combination of a displacement controlled hydraulic system and a metering system. In more detail, the first circuit may be adapted as a first displacement controlled actuator circuit, which includes the first variable displacement pump for actuating the first actuator at different speeds/flow rates. The second pump, on the other hand, can be used to drive the second actuator and/or assist actuation of the first actuator via a first control valve that connects the second pump with the first actuator under high speed conditions, that is, when shorter cycle times are required. It will be appreciated by the skilled practitioner that the actuation speed of one or more actuators of a construction machinery is determined by the so called "cycle time", which relates to the time needed to fully expand and retract a respective hydraulic actuator in air. According to the present invention, the shortest cycle time, which will be referred to as the minimal cycle time, is achieved by combining the flow of the first and second pumps. It is a customer expectation that a machine is capable of achieving the minimal cycle time and this is a key metric used to judge the performance of construction machinery. Yet, it was found that in most duty cycles, the minimal cycle time only needs to be achieved occasionally and that an average duty cycle (i.e. for average digging work cycles) requires relatively low actuation speeds on average.

In view of the above the particular arrangement of the present invention permits for the first pump to be sized smaller so as to be able to move the first actuator under normal/average speed conditions. Average speed requirements are ultimately determined via the demand of the operator of the machinery, during a particular duty cycle. If the first actuator is required to move quicker under certain circumstances, the fluid flow from the first pump can be assisted by the fluid flow from the second pump. Smaller sized pumps will reduce the cost of the hydraulic system when compared with traditional displacement controlled hydraulic systems that utilize large variable displacement pumps. Furthermore, it was found that using a plurality of smaller pumps will increase the efficiency of the entire hydraulic system. It should be understood that construction machinery may be provided with a plurality of different actuators, each of which could be supplied with flow from two or more different pumps to achieve the minimal cycle time, as will be described in more detail below.

In another embodiment, the first circuit is a closed loop circuit. The first circuit may be connected to a charge pump, which maintains the system at a slightly elevated fluid pressure, to prevent cavitation.

In a further embodiment, the second circuit is a closed loop circuit. In this case, the second circuit may be connected to a charge pump. Alternatively, the second circuit may be an open loop circuit, in which case the second pump draws hydraulic fluid directly from a fluid reservoir rather than being supplied with pressurized fluid from the charge pump.

According to another embodiment, the second pump is a variable displacement pump. The variable displacement second pump is particularly advantageous to control the second actuator at different speeds/flow rates. Alternatively or additionally, the second pump may be a fixed displacement pump which is connected to the second actuator and/or to the first actuator via proportional control valves which can be used to adjust the flow of the fluid supplied from the fixed displacement second pump to the second and/or first actuator.

In another embodiment, the first pump is directly connected/connectable to the first actuator, wherein the first control valve may be part of a valve assembly and constructed as a first proportional control valve adapted to variably restrict a fluid flow from the second pump provided to the first actuator. In this specification, the term "directly connected" refers to an arrangement in which the pump is connected to the actuator directly via fluid lines that do not comprise proportional or reducer valves (throttles) that would introduce artificial flow restrictions, unlike metering circuits that require one or more proportional valves to distribute the fluid flow of the pump. In other words, the direct connection refers to a connection, which does not result in energy losses of the fluid flow, apart from unavoidable losses within the fluid lines and/or valves which are required for safety purposes such as hose burst check valves, load holding valves or on/off valves, which do not intentionally add additional flow metering to the circuit. Consequently, the first actuator will always receive substantially all of the output flow provided by the first pump. Due to the direct connection of the first pump with the first actuator, the first circuit can be described as a displacement controlled circuit. In contrast to this, the second pump is preferably connectable to the first actuator via a first proportional control valve (metering valve), which is adapted to only supply a predetermined portion of the second fluid flow to the first actuator. Consequently, the fluid circuit created by the second pump that is connected to the first actuator via a metering/proportional valve, can be described as a metering circuit. As will be described in more detail below, the remaining portion of the second fluid flow, which is not used to support the flow of the first pump, may be applied to the second actuator simultaneously. As such, it is feasible for the second pump to assist the first pump in moving the first actuator, while simultaneously moving the second actuator.

In another embodiment, the first proportional control valve is a directional, proportional spool valve. The first proportional spool valve is preferably a 4/3 spool valve. The 4/3 spool valve comprises four fluid ports and 3 position. A first fluid port may be connected to the high pressure port (or pump flow) of the first pump, whereas a second fluid port maybe connected to the low pressure port (or flow return) of the first pump. A third fluid port may be connected to a first chamber of the first actuator, whereas a fourth fluid port may be connected to a second chamber of the first actuator. In a first position, the 4/3 spool valve is closed and none of the fluid ports are connected. In a second position, the first and a fourth fluid port as well as a second and a third fluid port are connected. Accordingly, in the second position, the high pressure port of the first pump may be connected to the second chamber, while the low pressure port is connected to the first chamber of the first actuator, for extending the latter. In a third position, the first and third fluid ports as well as the second and fourth fluid ports are connected, to retract the first actuator. In this case, the second pump can be constructed as a uni-directional pump, as the 4/3 spool valve can be used to connect the high pressure/flow port and the low pressure/flow port of the unidirectional pump to the desired high/low pressure/flow inlet of the first actuator.

In an alternative embodiment, the first proportional control valve is an independent metering valve. For example, the independent metering valve may be a bridge valve or a dual spool valve. The independent metering valve may be controlled to perform a compensation function to make up for the difference in volume in the chambers of the first actuator. To this end, the independent metering valve may be connected to a first chamber of the first actuator via a first fluid line and to a second chamber of the first actuator via a second fluid line, wherein a first pressure sensor may be provided in the first fluid line and a second pressure sensor may be provided in the second fluid line. The hydraulic system may comprises a control unit adapted to receive pressure information from the first and second pressure sensors, wherein the control unit may configured to control the independent metering valve to connect one of the first or second chamber to a fluid return line, depending on the pressure information. In traditional compensation valves, pilot activated check valves may be used to perform the compensation function. By contrast, according to this embodiment, the first and second pressure sensors may be used to determine the loaded and unloaded sides of the first actuator, which can then be used to connect one of the chambers of the first actuator to the fluid return gallery for compensation purposes. As such, the first proportional control valve can be used for a variety of different control functions and additional check valves are no longer required.

In another embodiment, the second control valve may be part of the valve assembly and constructed as a second proportional control valve adapted to variably restrict the second fluid flow of the second pump provided to the second actuator. The second proportional control valve is preferably a directional proportional spool valve, such as a 4/3 spool valve. According to this embodiment, the distribution of the second fluid flow from the second pump is regulated by standard control valves, which further reduce the cost of the hydraulic system of the present invention. Alternatively, the first and second proportional control valves could be combined into a single valve block, to reduce space requirements of the hydraulic system.

In another embodiment, the hydraulic system comprises a third actuator and a third pump connectable to the third actuator via a third circuit and adapted to drive the third actuator. Preferably, the third pump may be a variable displacement pump, which is connected to the third actuator via a closed loop third circuit. In other words, the third actuator may, similar to the first actuator, be displacement controlled by means of a variable fluid supply from the third pump.

According to another embodiment, the second pump may be fluidly connectable to the third actuator via a third control valve. As such, the second pump may not only be used to assist movement of the first actuator, but also to assist the third pump in moving the third actuator. To this end, the third control valve may be part of the valve assembly, which is configured and controlled to selectively distribute the fluid flow of the second pump to the first and/or second and/or third actuators.

Similar to the first circuit, the third pump in the third circuit may be directly connected or connectable to the third actuator, wherein the third control valve is a third proportional control valve adapted to variably restrict a fluid flow from the second pump provided to the third actuator. Again, the term "directly" refers to the fact that the third circuit is a displacement controlled circuit, and hence has a third pump that is connected to the third actuator without any flow reducing components, such as proportional/metering valves. The third proportional control valve may be a directional, proportional spool valve, preferably a standard 4/3 spool valve.

According to another embodiment, the first pump is configured as a bi-directional variable displacement pump and the second pump is configured as a uni-directional pump, wherein the first control valve is a directional control valve. According to this arrangement, the first pump is connected to the first actuator by a closed loop circuit and configured as a bi-directional pump to supply either of the actuator inlets selectively with pressurized hydraulic fluid. The second pump is preferably connectable to both the first and second actuator via a directional control valve, and thus does not require a bi-directional pump. When using a uni-directional pump as the second pump, the second circuit may either be constructed as an open or closed loop circuit.

According to another embodiment, the first pump comprises a first pump port connected or selectively connectable to a first chamber of the first actuator and a second pump port connected or selectively connectable to a second chamber of the first actuator. When the first pump is a bi-directional pump, both the first and second ports can be either is used as high or low pressure port. As such, when the first port of the first pump is a high pressure port, the first chamber of the first actuator is connected to a high pressure side of the pump, whereas the second port is then a low pressure port, hence connecting the second chamber of the actuator with a low pressure side of the pump. The opposite is the case, if the direction of the pump is reversed, such that the second port is the high pressure port. Consequently, supply of high pressure fluid from the first pump can be supplied to the first and/or second chamber of the first actuator. In another embodiment, load holding valves could be added between the ports of the pump and the chambers of the actuator. It should be understood that these load holding valves would not introduce a metering function. Accordingly, the first pump would still be "directly connected" to the first actuator.

In another embodiment, the second pump comprises a first port selectively connectable to the first or second chamber of the first actuator via the second control valve and a second port selectively connectable to the first or second chamber of the first actuator via the second control valve. The second pump of this embodiment is connectable to both chambers of the first actuator by means of the second control valve, which may be constructed as a standard 4/3 valve. As mentioned previously, this embodiment enables the second pump to be constructed as a uni-directional pump.

According to yet another embodiment, the second pump is arranged to act as a charge pump maintaining the hydraulic system at an elevated fluid pressure. Consequently, the hydraulic system of this embodiment does not require a separate charge pump; rather the second pump has three functions, namely to supply the first and second actuators and act as a charge pump for the system pressure.

The second circuit may be an open circuit. In particular, the second pump may comprise a first port selectively connectable to the first or second chamber of the first actuator via the first control valve and a second port connected to a hydraulic fluid reservoir. The first port of the second pump may further be connected to the hydraulic fluid reservoir via a bypass-valve, such as a variable pressure relief valve. The bypass-valve may be changed between at least two predetermined set pressure relief values. If the bypass-valve is constructed as a variable pressure relief valve, a first pressure relief value may relate to a maximum allowable pressure for the first and second actuators, whereas a second relief value may be as low as possible such that the variable pressure relief valve does not provide any significant restriction to the fluid flow. Of course, the bypass-valve may be constructed in any other suitable manner, such as an on/off valve in connection with a fixed pressure relief valve.

In another embodiment, the third circuit is constructed substantially identical to the first circuit and comprises a third pump with a first port connected or selectively connectable to a first chamber of the third actuator and a second port connected or selectively connectable to a second chamber of the third actuator. The first and second ports of the second pump may be selectively connectable to the first or second chamber of the third actuator via a third control valve.

In another embodiment, the first and second ports of the second pump may be selectively connectable to first or second chambers of the second actuator via the second control valve.

In another embodiment, the first and second pumps are connected to a prime mover by a common drive mechanism, such as a common drive shaft. Third and fourth pumps may be connected to the same prime mover via a second common drive shaft. The two drive shafts maybe connected to a gearing/variable ratio mechanism at the output of the prime mover in such a way that the first and second common drive shafts can be rotated at the same or different rotational speed. Accordingly, the first and second pumps are preferably driven at the same rotational input speed by means of the common drive shaft but may still provide different outlet flows. For example, the first and second pumps may be variable displacement swash-plate pumps which may adjust their respective output flow rate independent of the rotational speed of the common drive shaft. Of course, this arrangement will render the hydraulic system of the present invention more compact and cost effective as only a single prime mover is required. As mentioned previously, the third pump and potentially further pumps may preferably also be connected to the single prime mover via the second common drive shaft. It is also feasible to connect all of the pumps to a single common drive shaft. The invention is, however, not limited to a single prime mover driving the pumps via one or more common drive shafts. The skilled practitioner will appreciate that the pumps could be driven by one or more prime mover/s. The prime mover/s may be a fuel engine or an electric motor, either of which may be connected to the pump/s via a variable gear/ratio mechanism. There may be one prime mover per pump or one prime mover for all of the pumps.

According to another embodiment, the prime mover may be a single speed motor. Even if the motor is a single speed motor, it is feasible to drive the various pumps of the present system at different speeds by means of variable gear/ratio mechanisms. Accordingly, when using a single speed motor, each or some of the pumps maybe connected to the motor via a common or separate variable drive mechanism/s. Alternatively, the prime mover may be an internal combustion engine, such as a diesel engine.

In another embodiment, the first pump is sized such that the maximum output flow rate of the first pump equals 25% to 75%, preferably 40% to 60% more preferably 45% to 55% of a peak flow rate necessary to drive the first actuator at a predetermined minimal cycle time. In other words, the first pump may be sized to provide a maximum flow rate sufficient to move the first actuator under regular speed requirements, which equal 25% to 75% of the speed/flow requirements to achieve the minimal cycle time, predetermined by the construction machinery manufacturer. In particular, the "minimal cycle time", relates to the shortest time needed to fully expand and retract a respective hydraulic actuator. For example, if the first actuator is a hydraulic ram used to lift the boom of an excavator, then the first pump may be sized to provide a maximum fluid flow rate that equates 25% to 75% of the flow rate required to lift and retract the boom at the a predetermined maximum speed, that is, 25% to 75% of the flow rate required to perform a full actuation cycle of the boom within the minimal cycle time. It should be noted that the cycle time is measured in air, i.e. when the boom does not have to work against any resistance other than gravity. In one exemplary embodiment, the predetermined minimal cycle time could be set to be about 5 seconds. In this example, the first pump would be sized such that the maximum flow rate provided by the first pump would be sufficient to achieve a longer cycle time of about 7.5 to 20 seconds. If an operator wishes to obtain the faster, minimal cycle time for actuating the boom, the maximum output flow rate of the first pump will not be sufficient to move the first actuator at the desired speed (i.e. to achieve the predetermined minimal cycle time) and hence assistance from the second pump will be required. It will be appreciated that the second pump is then sized complimentary to the first pump, such that a combination of the first and second pumps is sufficient to achieve the predetermined minimal cycle time. Of course, the invention is not restricted to the particular example of cycle times stated hereinbefore. In this regard, it should be appreciated that different cycle times, and hence different actuation speeds, apply to different actuators of construction machinery. For example, while the boom actuator of an excavator may need to achieve a fastest/minimal (i.e. second) cycle time of 6 seconds, the minimal cycle time for a dipper actuator may be 4 seconds and 2.5 seconds for a bucket actuator.

Of course, the skilled person will appreciate the general requirement for the respective construction machinery to fulfill certain minimal cycle times, which are mainly determined by the customers demand. As such, the skilled practitioner is able to calculate the required maximum fluid flow rate value, which needs to be provided to move an actuator at a speed sufficient to achieve said minimal cycle time. The first pump will then be sized to exhibit a fluid flow that relates to 25% to 75% of the aforementioned maximum fluid flow rate value. It was found that sizing the first pump this way will result in substantially improved energy efficiency.

The hydraulic system of the present invention is restricted to working under normal/average speed conditions if only the first pump is used to supply the first actuator. However, the system is also configured to achieve the faster "minimal" cycle time by supplying the first actuator with pressurised fluid from the first and the second pump. That is, the hydraulic system of the present invention is also adapted to provide a second, higher fluid flow rate by combining the high pressure outlets of the first and second pumps. In contrast to this, commonly known displacement controlled hydraulic systems comprise heavily oversized displacement pumps for each actuator, which are capable of achieving the minimal cycle time independently, without assistance from other pumps. However, under regular speed conditions commonly known displacement pumps work at about 50% of their maximum outlet flow. Smaller pumps, according to this embodiment, that work at about 90% of their maximum outlet flow during normal working conditions are not only less expensive but work more efficiently.

In another embodiment, the hydraulic system comprises a controller connected to the first control valve and adapted to control the first control valve to selectively connect the second pump to the first circuit, if the maximum fluid flow output rate of the first pump is not sufficient to move the first actuator at high speed, that is, at shorter cycle times. In this embodiment, the controller may be connected to a sensor device connected to an operator interface. In particular, the sensor device may be connected to an input device, such as a joystick, used by the operator to control movement of the first actuator. The desired actuation speed may be a function of the joystick position. It will be appreciated that according to one example, the desired speed may increase with the amount of displacement of the joystick. If the displacement sensed by the sensor device indicates a desired actuation speed/cycle time that exceeds the maximum fluid flow capability of the first pump, the controller will adjust the first control valve such that all or part of the second fluid flow from the second pump is diverted to the first actuator.

The first control valve may comprise a proportional control valve. The proportional control valve may be connected to the controller such that the controller can adjust the proportional control valve such that the portion of the second fluid flow, which is directed to support the first pump in moving the first actuator, is sufficient to obtain the desired speed sensed by the sensor device. The controller may adjust the proportional control valve such that only a necessary amount of the second fluid flow is supplied to the first circuit. The remaining parts of the second fluid flow can simultaneously be used to move the second actuator.

In another embodiment, the third pump is sized such that the maximum output flow rate of the third pump equals 25% to 75%, preferably 40% to 60% more preferably 45% to 55% of a peak flow rate necessary to drive the third actuator at a predetermined minimal cycle time.

In another aspect, the second pump may be fluidly connectable to the third actuator via a third control valve to support the third pump in moving the third actuator at higher speed, to obtain faster cycle times as set out hereinbefore with respect to the first actuator. The valve assembly of this embodiment, comprising the first, second and third control valve, may be configured such that the second pump is fluidly connectable to the first and third actuator simultaneously or in sequence.

The aforementioned controller may also be adapted to control the third control valve to selectively connect the second pump to the third circuit, if the maximum fluid output flow of the third pump is not sufficient to move the third actuator at high speed, i.e. at a predetermined minimal cycle time for the third actuator.

According to another embodiment, the first pump is sized to exhibit a maximum output flow, which is 50% to 150%, preferably 75% to 125%, more preferably 95% to 105%, of the maximum output flow of the second pump. Preferably, the third pump is also sized to exhibit a maximum output flow, which is 50% to 150%, preferably 75% to 125%, more preferably 95% to 105%, of the maximum output flow of the second pump. According to this embodiment, the first, second and third pumps are sized in a similar manner. As such, the first and third actuators can be moved with a maximum flow, which equates approximately twice the maximum output flow of the first or third pump respectively. Consequently, the faster, second cycle time can be reduced to 50% of the first cycle time. In the aforementioned example, the cycle time of the first actuator could thus be reduced from 10 seconds to 5 seconds, by combining the flow of the first and second pump in operating the first actuator.

In a particularly advantageous embodiment, the first, second and third pumps are identically sized, which reduces the cost of the present hydraulic system even further.

In another embodiment, the hydraulic system further comprises a fourth actuator and a fourth pump connectable to the fourth actuator via a fourth circuit and adapted to drive the fourth actuator. The fourth actuator may be rotary actuator, and in particular a hydraulic motor for slewing a construction machinery.

In another embodiment, the system further comprises a fifth actuator, wherein the first pump is selectively connectable to the fifth actuator. Preferably, the first pump is directly connectable to the fifth actuator, that is, via valves, which do not restrict the fluid flow provided by the first pump. The valves can be constructed as a single diverter valve or a plurality of on/off valves.

In another embodiment, the system further comprises a sixth actuator, wherein the third pump is selectively connectable to the sixth actuator. The third pump is preferably directly connectable to the sixth actuator by means of valves, which do not restrict the flow provided by the third pump. The valves can be constructed as a single diverter valve or a plurality of on/off valves.

It should be understood that the aforementioned arrangement of the fifth and sixth actuator enable the operator to activate all of the six actuators simultaneously with only four pumps. For instance, while the first and third pumps might be used to activate the fifth and sixth actuator for tracking of the construction machine (e.g. excavator), the second pump may be utilized to drive the first, second and/or third actuator, via the first, second and third control valve. In an excavator, this would enable tracking of the machine at the same time as moving the dig end.

The present invention further relates to a construction machine comprising the hydraulic system described herein before.

BRIEF DESCRIPTION OF THE DRAWINGS

Embodiments of the invention will now be described, by way of example only, with reference to the accompanying figure, in which.

DETAILED DESCRIPTION OF THE INVENTION

Figure 1A:
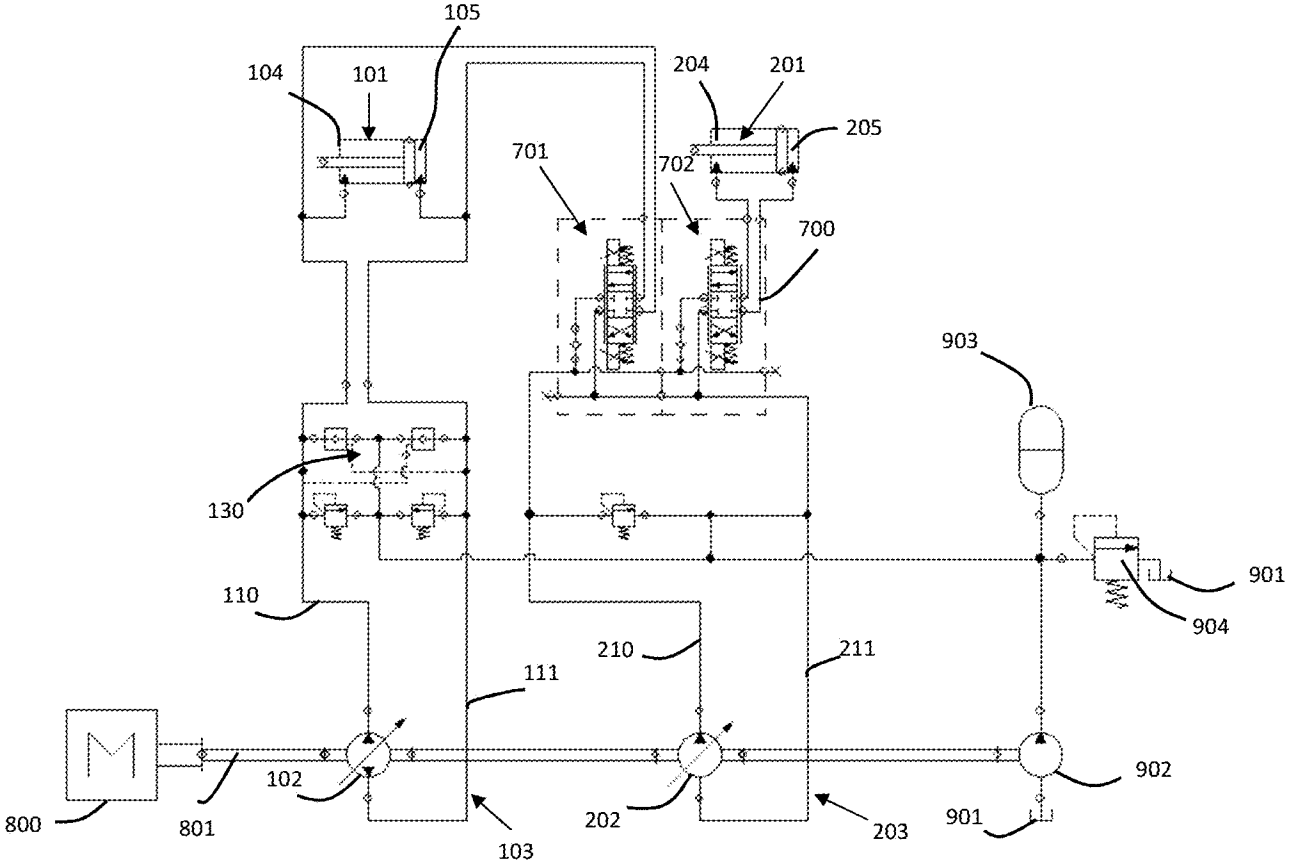
FIG. 1*a* shows a schematic of a hydraulic system according to an embodiment of the present invention.

FIG. 1*a* shows a schematic of a hydraulic system according to an embodiment of the present invention. By way of example, this embodiment of the hydraulic system will be described below in connection with an earth moving device, such as an excavator. However, it should be understood that the hydraulic system shown in FIG. 1 is not restricted to this application and is suitable for a variety of different machinery.

The hydraulic system comprises a first actuator 101 which is connected to a first pump 102 via a first circuit 103. The first actuator may be a linear actuator, such as a hydraulic cylinder. The first circuit 103 of FIG. 1*a* is depicted as a closed loop circuit, containing the first pump 102 connectable to the first actuator 101. The first pump 102 is connectable to the first actuator 101 via first and second fluid lines 110, 111.

The first pump 102 is shown as a bi-directional, variable displacement pump, which is connectable to a first chamber 104 of the first actuator 101 via the first fluid line 110. A second outlet port of the first pump 102 is connected to a second chamber 105 of the first actuator 101 via second fluid line 111. Since the first pump 102 is a bi-directional pump, pressurized fluid may be provided to the first chamber 104 via fluid line 110 or, alternatively, to chamber 105 via second fluid line 111. By changing the displacement of the first pump 102, the first actuator 101 may be operated at different speeds.

FIG. 1*a* further shows a second pump 202, which is connectable to a second actuator 201 in a second fluid circuit 203. The second pump 202 is selectively connectable to the first actuator 101 by means of a first control valve 701. The second pump 202 is further selectively connectable to the second actuator 201 by means of a second control valve 702. In particular, the first and second control valves 701, 702 are part of a valve arrangement 700, as depicted in FIG. 1*a*. Both control valves 701 and 702 are constructed as solenoid actuated proportional spool valves. In more detail, both of the spool valves of the control valves 701 and 702 are 4/3 directional spool valve, which are biased towards their closed position.

The second pump 202 is a uni-directional variable displacement pump, which is connectable via the second control valve 702 to the second actuator 201. The uni-directional second pump 202 comprises a first high pressure port, which is connected to the second control valve 702 of the valve arrangement 700 via first fluid line 210 of the second circuit 203. The low pressure port of the second pump 202 is connected to the second control valve 702 via the second fluid line 211 of the second fluid circuit 203. At its rest position, the second control valve 702 is closed, that is, the connection between the second pump 202 and the second actuator 201 is shut off. In a first position (downwards in FIG. 1*a*), the valve 702 connects the high pressure port of the second pump 202 to a first chamber 204 of the second actuator via fluid line 210 and the second chamber 205 of the second actuator 201 with the low pressure port of the second pump 202 via fluid line 211, thus retracting the second actuator 201. In its second position (upwards in FIG. 1*a*), the second control valve 702 connects the high pressure port of the second pump 202 with the second chamber 205 of the second pump 201 via fluid line 210 and the low pressure port of the second pump 202 with the first chamber 204 of the second actuator via fluid line 211, thus extending the second actuator 201.

The second pump 202 is connectable to the first pump 102 in a similar manner by means of the first control valve 701. In detail, the second pump 202 is disconnected from the first actuator 101, when the first control valve 701 is in its rest position. In the first position of the first control valve 701 (downwards in FIG. 1*a*), the high pressure port of the second pump 202 is connected with the second chamber 105 of the first actuator 101 and the low pressure port of the second pump 202 is connected to the first chamber 104 of the first actuator 101. This first position of the first control valve 701 can be used to assist the first pump 102 with extending the first actuator 101. When the first control valve 701 is in its second position (upwards in FIG. 1*a*), the high pressure port of second pump 202 is connected to the first chamber 104 of the first actuator 101 and the low pressure port of the second pump 202 is connected to the second chamber 105 of the first actuator 101, thus assisting the first pump 102 with retracting the first actuator. It will be appreciated that the first and second pumps 102, 202 as well as the first control valve 701 are controlled in such a way that the high pressure port of the first pump 102 and the high pressure port of the second pump 202 are always connected to the same chamber of the first actuator 101. Of course, the same applies to the low pressure ports of the first and second pumps 101, 202, which will also be connected to the same chamber.

The valve arrangement 700 is connected to a controller (not shown), which will regulate positioning of the first and second control valves 701 and 702 in response to demands for actuation speed of the first, second actuators 101, 201. Under normal/average conditions, the first pump 102 will independently provide the first actuator 101 with pressurized fluid in a displacement controlled manner. As such, the high pressure flow of the first pump 102 will be connected to the second chamber 105 if the piston rod of the first actuator 101 (linear actuator, such as hydraulic cylinder) shall be extended out of the cylinder housing (to the left in FIG. 1*a*). In order to retract the linear actuator, the pumping direction of the first pump 102 is reversed such that the high pressure port of the first pump 102 is connected to the first chamber 104 and low pressure port is connected to the second chamber 105 of the first actuator 101. If the maximum fluid output flow of the first pump 102 is not sufficient to extend the first actuator 101 at the desired speed, the controller may transfer the first control valve 701 into its first position (downwards in FIG. 1*a*), such that the high pressure outlet of the second pump 202 is connected to the second chamber 105 in order to assist the first pump 102 in extending the ram of the first actuator 101. If the maximum fluid output flow of the first pump 102 is not sufficient to retract the first actuator 101 at the desired speed, the controller may transfer the first control valve 701 into its second position (upwards in FIG. 1*a*), such that the high pressure outlet of the second pump 202 is connected to the first chamber 104 in order to assist the first pump 102 in retracting the ram of the first actuator 101.

The first and second control valves 701 and 702 may be proportional spool valves such that the fluid flow/pressure supplied by the second pump 202 to the first and second actuators 101 and 201 can be distributed according to demand. That is, if only a small amount of additional flow/pressure is required to extend the first actuator 101 at the desired speed, the controller will adjust valve 701 such that only a small part of the second fluid flow supplied by the second pump 202 is diverted to the first or second chamber 104, 105 of the first actuator 101. The remaining flow provided by the second pump 202 may therefore be used to drive the second actuator 201 simultaneously.

In the embodiment shown in FIG. 1*a*, the first and second pumps 102, 202 are driven by a common drive shaft 801, which connects each of the pumps 102, 202 to a single prime mover, shown as drive motor 800, such as a combustion engine or electric motor. The drive motor 800 is also connected to a charge pump 902 via the common drive shaft 801, as will be described in more detail below. The invention is not limited to this particular drive arrangement. For example, any prime mover could be used to drive the pumps and the pumps maybe connected to a plurality of prime movers via a plurality of drive shafts, examples of which are described below.

Figure 1B:
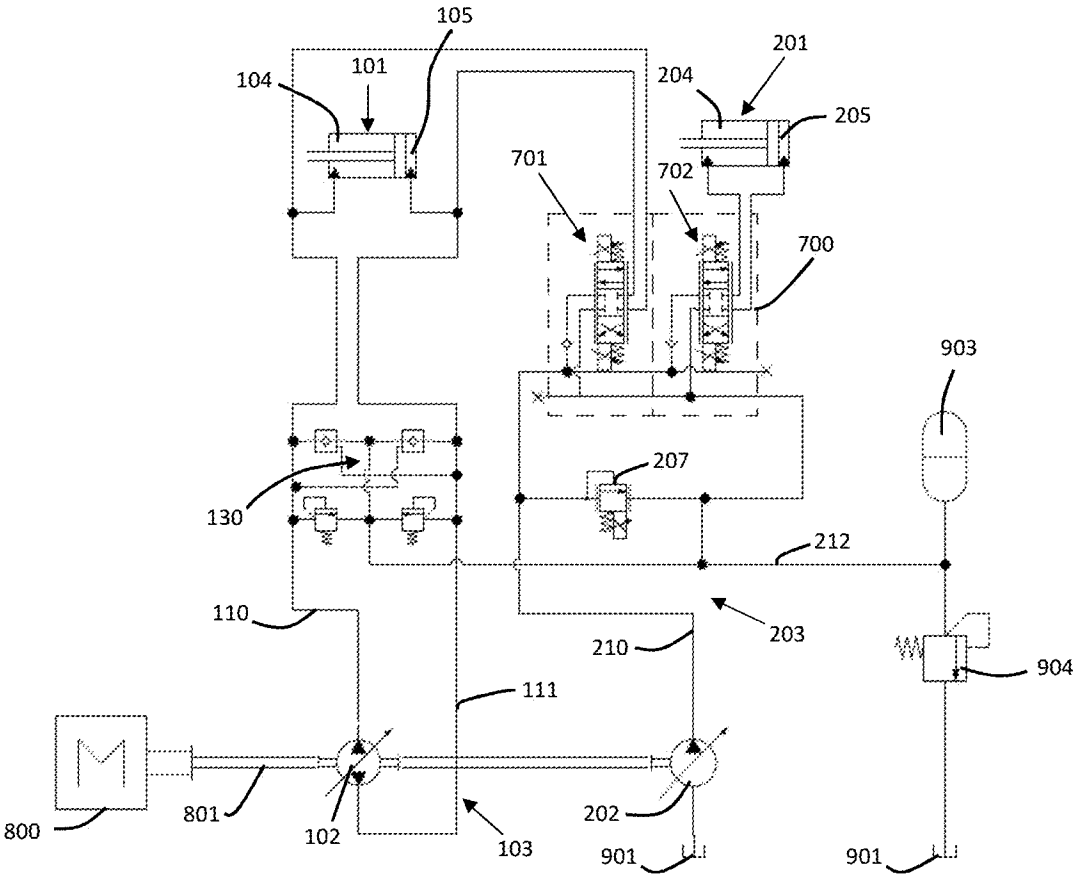
FIG. 1*b* shows a schematic of a hydraulic system according to an embodiment of the present invention.

Turning to FIG. 1*b*, there is shown another embodiment of the present hydraulic system. Parts of the embodiment shown in FIG. 1*b*, which are identical to the embodiment in the drawing of FIG. 1*a* are labeled with identical reference signs. The embodiment of FIG. 1*b* differs from the embodiment of FIG. 1*a* in that the second fluid circuit 203 is an open circuit. While the uni-directional second pump 202 still comprises a first high pressure port, which is connected to the first and second control valves 701, 702 via a first fluid line 210, the low pressure port of the second pump 202 is now connected to the hydraulic fluid reservoir 901. The return ports of the first and second control valves 701, 702 are now connected to the hydraulic fluid reservoir 901, via second fluid line 212 and relief valve 904.

An inlet port of a bypass-valve, in this embodiment a variable pressure relief valve 207, is connected to the high pressure outlet port of the second pump 202 via fluid line 210. An outlet port of the variable pressure relief valve 207 is connected to an inlet port of relief valve 904 and an inlet port of the accumulator 903 via the second fluid line 212.

During actuation of the first and/or second actuators 101, 201, the variable pressure relief valve 207 is set to a first relief value at a predetermined maximum operating pressure of the first and/or second actuator 101, 201. In other words, the variable pressure relief valve 207 acts as a safety relief valve if pressure in the respective chambers of the first and/or second actuators exceed a pre-determined threshold. During operation of the first and/or second actuator 101, 201, return flow from the first and/or second actuators 101, 201 is directed towards the hydraulic fluid reservoir 901 via the relief valve 904. As such, during use of the first and/or second actuator 101, 201, the return flow charges the system.

When neither the first nor the second actuator 101, 201 is in use, that is, when the first and second control valves 701, 702 are closed, the variable pressure relief valve 207 is set to a second relief value. The second relief value may be a fully open state in which the second pressure relief valve does not restrict the fluid flow between fluid lines 210 and 212 significantly. The second pump 202 then solely acts as a charge pump and will set the system pressure by filling accumulator 903 up to a pressure value set by relief valve 904.

The variable pressure relief valve 207 may be a solenoid actuated relief valve or any other suitable valve that allows a rapid interchange between two pre-determined relief values.

Figure 1C:
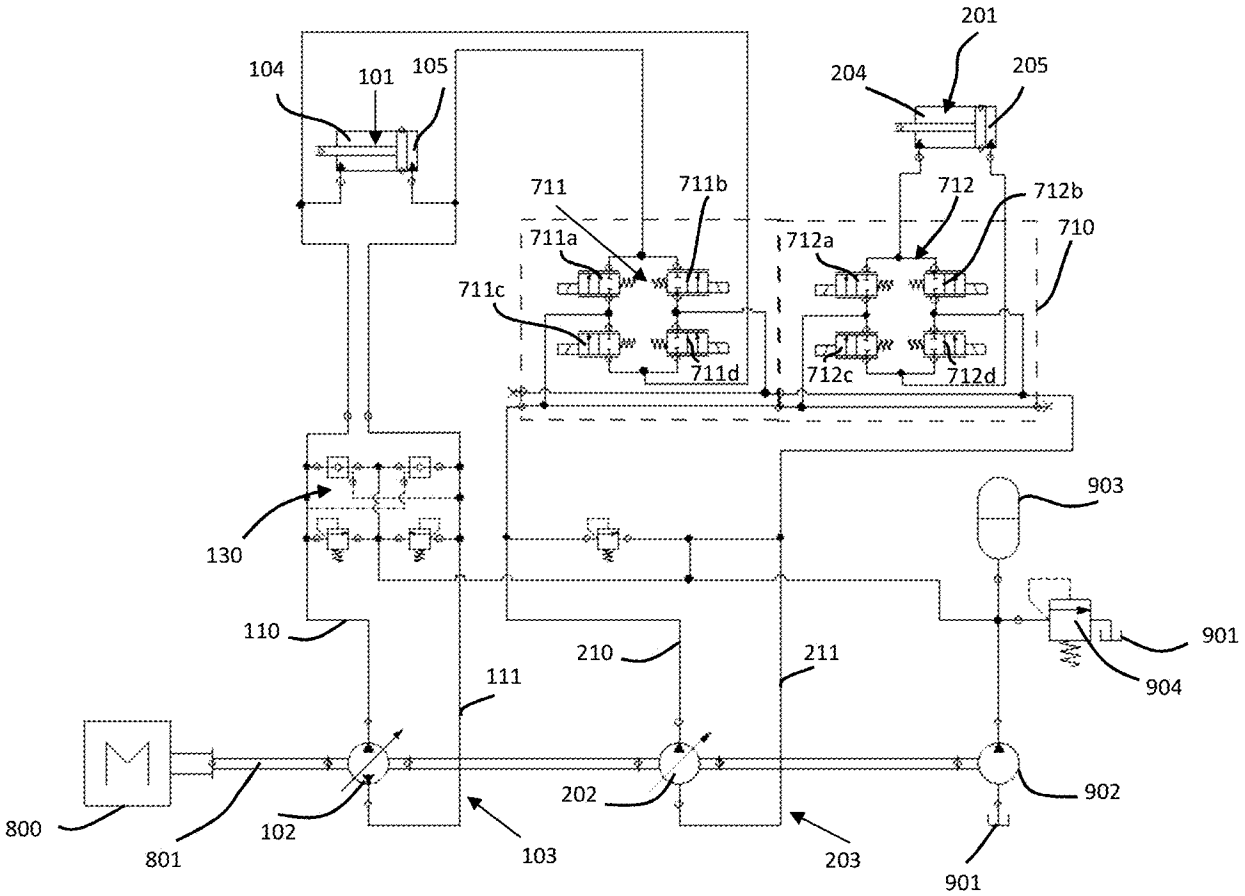
FIG. 1*c* shows a schematic of a hydraulic system according to an embodiment of the present invention.

Yet another embodiment of the present hydraulic system is shown in the schematic drawing depicted in FIG. 1*c*. Parts of the embodiment shown in FIG. 1*c*, which are identical to the embodiment in the drawing of FIG. 1*a* are labeled with identical reference numbers. As will be appreciated, the embodiment according to FIG. 1*c* only differs from the embodiment of FIG. 1*a* in that the valve arrangement 710 comprises first and second control valves 711, 712, which are constructed as bridge valves. Each of the bridge control valves 711, 712 comprises four independently controllable metering valves 711*a*, 711*b*, 711*c*, 711*d*, 712*a*, 712*b*, 712*c*, 712*d*. Each of the independent metering valves 711*a*, 711*b*, 711*c*, 711*d*, 712*a*, 712*b*, 712*c*, 712*d* is constructed as a normally closed 2/2 proportional solenoid valve. The independent metering valves 711*a*, 711*b*, 711*c*, 711*d*, 712*a*, 712*b*, 712*c*, 712*d* can be poppet or spool valves or any other kind of metering valve the skilled person would see fit. If the second pump 202 is used to assist the first pump 102 in driving the first actuator 101 to extend the piston rod, the controller moves the first metering valve 711*a* into its second position (towards the right in FIG. 1*c*) to connect the high pressure outlet of pump 202 with the chamber 105 of the first actuator 101, via the first fluid line 210. At the same time, the controller opens independent solenoid valve 711*d* such that the first chamber 104 of the first actuator 101 is connected to the low pressure port of the second pump 202, via the second fluid line 211. If, on the other hand, the second pump 202 is used to retract the piston of the first actuator 101, the high pressure fluid port of pump 202 is connected to the first chamber 104, while the low pressure fluid port is connected to the second chamber 105. To this end, the controller opens independent valves 711*c* and 711*b*, while valves 711*a* and 711*d* remain closed.

The function of the second bridge control valve 712 of the valve arrangement 710 is substantially identical to the function of the first bridge control valve 711. Of course, in contrast to the first bridge control valve 711, the second bridge control valve 712 selectively connects the second pump 202 to the second actuator 201. It will be appreciated that the valve arrangements 710 of the embodiment shown in FIG. 1*c* allows for individual metering of the high pressure and low pressure fluid lines of the second circuit 203. For example, the first bridge control valve 711 allows for the high pressure fluid flow of the second pump to be metered via independent metering valve 711*a* when extending the first actuator 101, while fluid being pushed out of the first chamber 104 of the first actuator 101 can be connected to the low pressure port of the second pump, without any metering along valve 711*d*. That is, the bridging valve arrangement of the embodiment shown in FIG. 1*c* allows for differential metering of the fluid flows in the first and second fluid lines 210, 211.

Figure 1D:
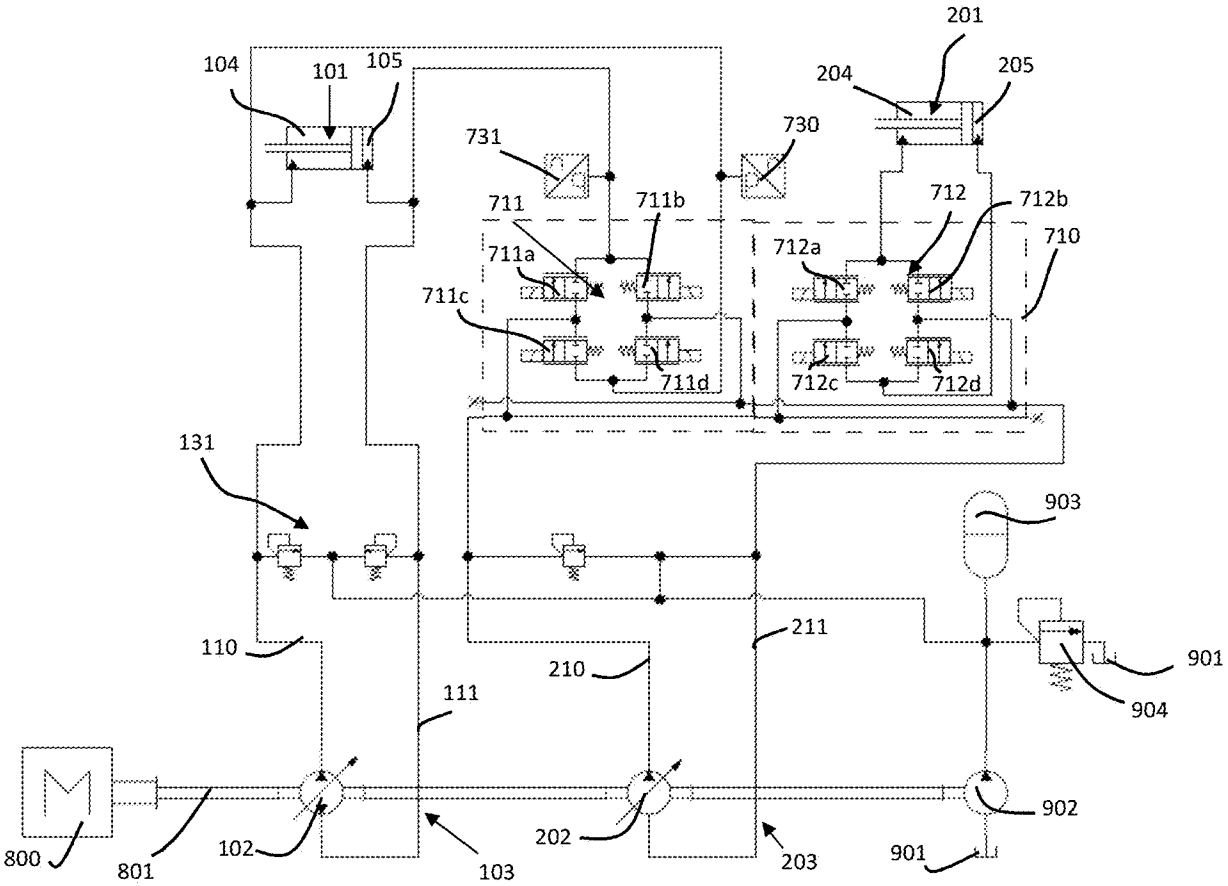
FIG. 1*d* shows a schematic of a hydraulic system according to an embodiment of the present invention.

In FIG. 1*d* there is shown another embodiment of a hydraulic system according to the present invention. Parts of the embodiment shown in FIG. 1*d*, which are identical to parts of the embodiment according to FIG. 1*c* are labeled with identical reference signs. In contrast to the anti-cavitation system 130 of FIG. 1*c*, the embodiment shown in FIG. 1*d* shows an anti-cavitation system 131, which no longer requires pilot operated check valves. Instead, the embodiment of FIG. 1*d* includes first and second pressure sensors 730, 731 which are provided in the fluid lines that connect the first control valve 711 with the first actuator 101. In particular, a first pressure sensor 730 is arranged in a first fluid line between the first control valve 711 and the first chamber 104 of the first actuator 101. A second pressure sensor 731 is provided in the fluid line between the first control valve 711 and the second chamber 105 of the first actuator 101.

According to the embodiment in FIG. 1*d*, the first control valve, which is constructed as a bridge valve, may be used to compensate for differences in volume between the first chamber 104 and the second chamber 105 of the first actuator 101. To this end, the first and second pressure sensors 730, 731 may be connected to a control unit, which in turn controls actuation of the independent metering valves 711*a*, 711*b*, 711*c*, 711*d* of the first control valve 711. The first and second pressure sensors 730, 731 measure the pressure across the first actuator 101 to determine which of the first and second chambers 104, 105 are loaded and unloaded respectively. The first control valve 711 may then connect the unloaded chamber to the fluid return line, i.e. to the second fluid line 211 of the second fluid circuit 203. In more detail, if the first chamber 104 is resistively loaded, the piston will move towards the second chamber 105, which is then unloaded and hydraulic fluid will be expelled from the second chamber 105. Due to the difference in volume between the rod side first chamber 104 and the head side second chamber 105, the first fluid circuit 103 will be provided with an excess of hydraulic fluid which can be released via the first control valve 711. In particular, in the above scenario, the control unit may open metering valve 711*b* in order to connect the second chamber 105 with the fluid return line, i.e. with second fluid line 211. If the first actuator 101 is extended, i.e. if the second chamber 105 is resistively loaded, the unloaded first chamber 104 may be connected to the fluid return line, i.e. the second fluid line 211 via the first control valve 711. In detail, the control unit may open metering valve 711*d* in order to connect the first chamber 104 of the first actuator 101 with the second fluid line 211. The skilled person will appreciate that the opposite is the case if the first actuator is over-running.

Figure 1E:
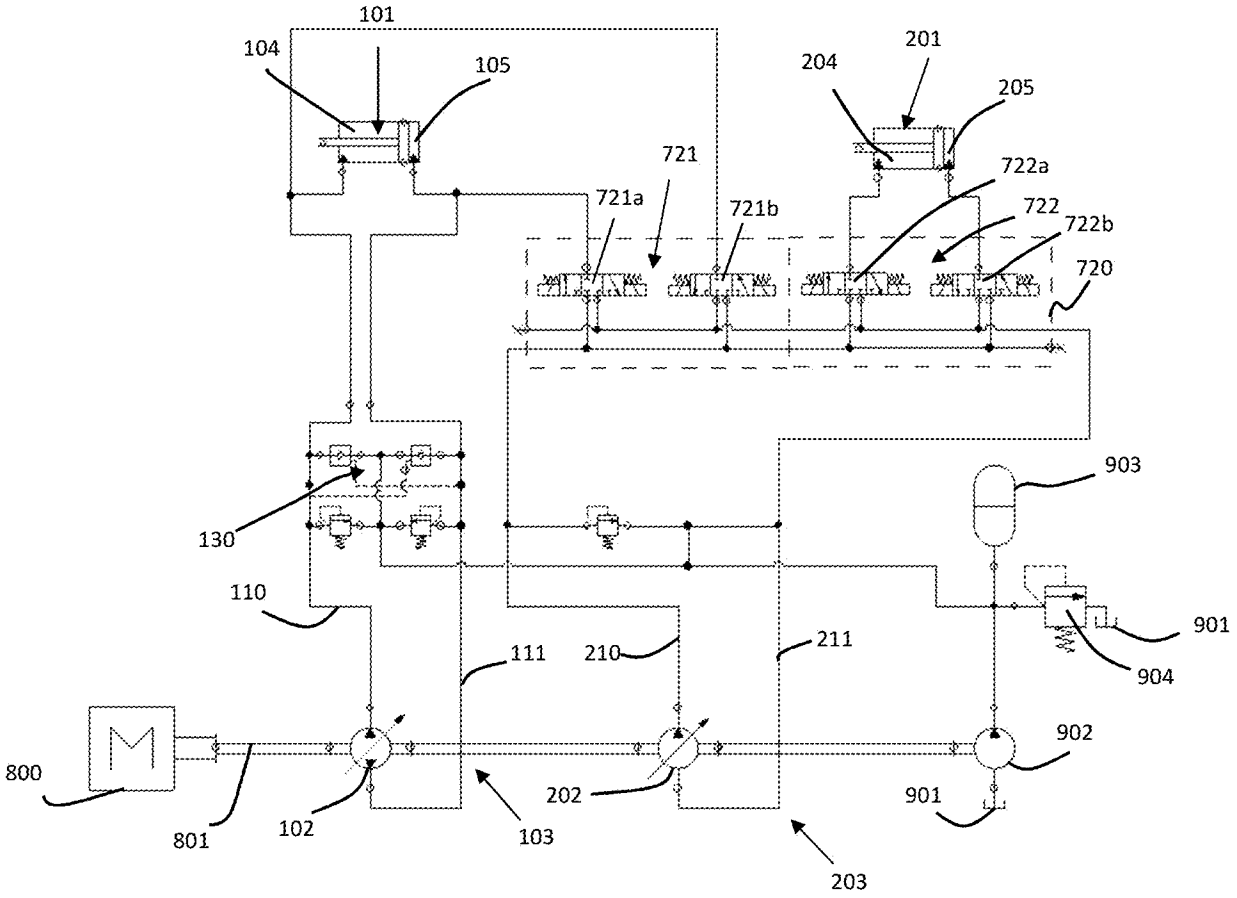
FIG. 1*e* shows a schematic of a hydraulic system according to an embodiment of the present invention.

Another embodiment of the present hydraulic system is shown in FIG. 1*e*. Parts of the embodiment shown in FIG. 1*e*, which are identical to parts of the embodiment according to FIG. 1*a* are labeled with identical reference signs. The embodiment according to FIG. 1*e* shows another valve arrangement 720, which differs from the valve arrangements 700 and 710 shown in FIGS. 1*a* and 1*c*. The valve arrangement 720 shown in FIG. 1*e* has first and second control valves 721, 722, each of which include first and second independent metering spool valves 721*a*, 721*b*, 722*a* and 722*b*. Similar to the embodiment of FIG. 1*c*, the independent metering valves 721*a* and 721*b* can be used to meter the fluid flow in the first and second fluid lines 210, 211, between the second pump 202 and the first actuator 101, separately. Similarly, the first and second spool valves 722*a*, 722*b* of the second control valve 722 can be used to independently meter the fluid flow between the first and second fluid flow lines 210, 211 and the chamber 204, 205 of the second actuator 201.

As mentioned previously, the first and second pumps 102, 202 can be driven by any kind of prime mover such as an electric or fuel motor 800, which is connected to each of the pumps via a common connector shaft 801. In another embodiment of the present invention, shown in FIG. 1*e*, each of the pumps 122, 222 and 902 is connected to a separate prime mover 810, 820, and 830. In a particular embodiment of FIG. 1*f*, the prime movers 810, 820, 830 are connected to their respective pump 102, 202, 902 via connector shafts 811, 821, 831. The prime movers or motors 810, 820, 830 are preferably adapted to drive the connector shaft 811, 821 or 831 at varying revolution speeds, thereby varying the output flow rate of their respective pumps 122, 222, 902. It will be appreciated that the first and second pumps 122, 222 of this embodiment may thus be fixed displacement pumps, as the output flow rate is controllable by varying the revolution speed of the individual connector shafts 811, 821 via prime movers or motors 810, 820. Alternatively, the motors 810, 820 may be single speed motors and comprise an adjustable gearing mechanism, which connects the output of the motor 810, 820, 830 with the connector shafts 811, 821, 831 so as to drive the connector shafts 811, 821, 831 at varying revolution speeds.

Figure 1F:
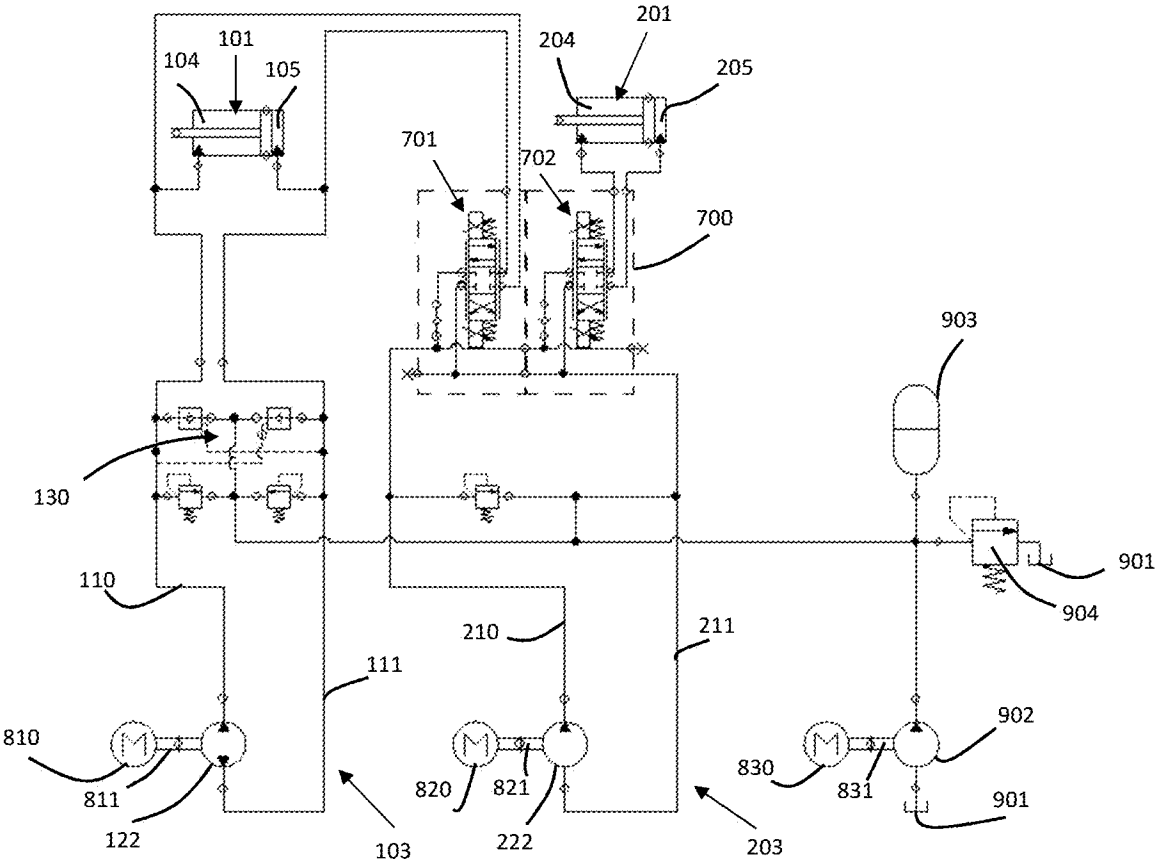
FIG. 1*f* shows a schematic of a hydraulic system according to an embodiment of the present invention.
Figure 1G:
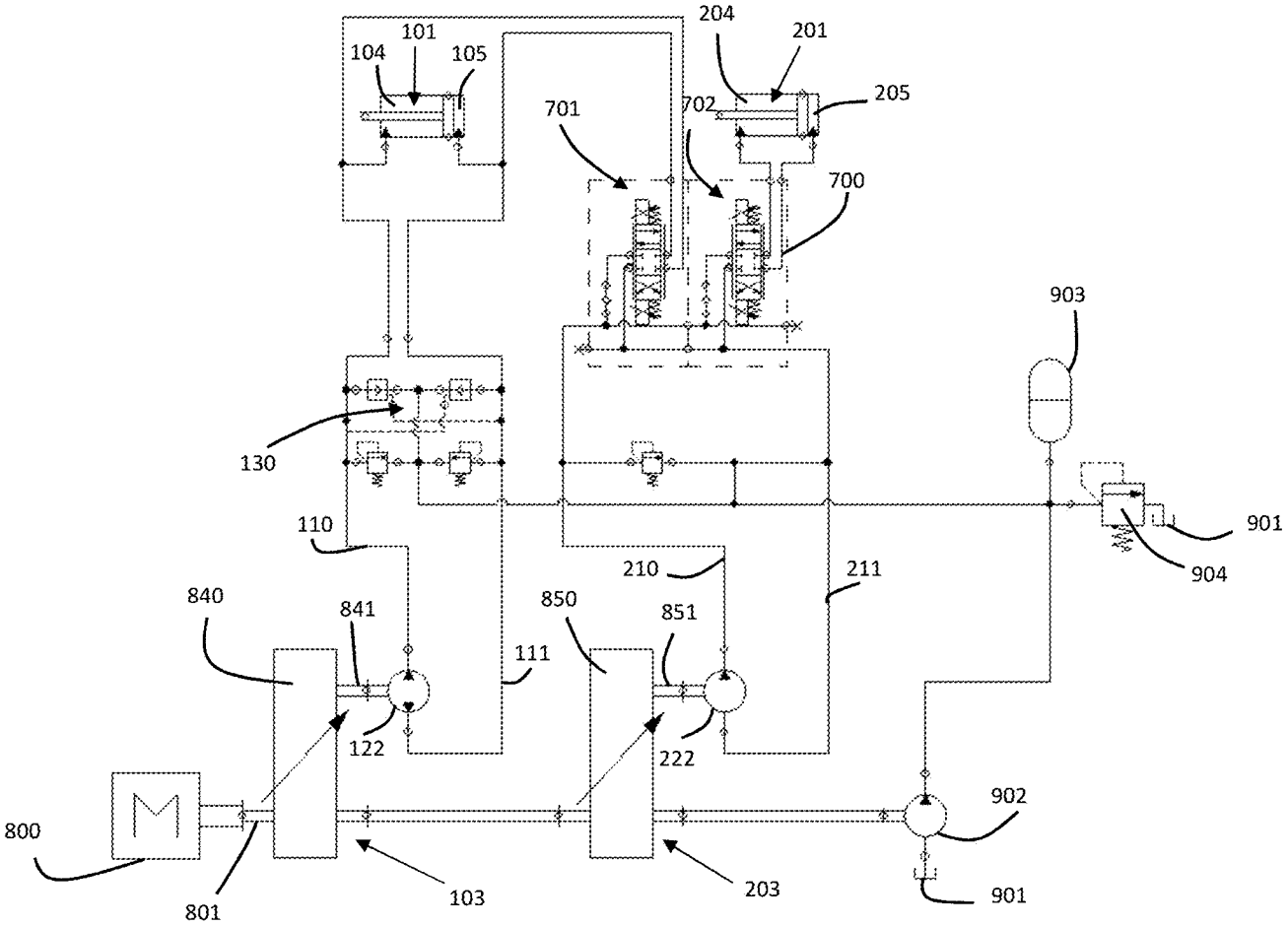
FIG. 1*g* shows a schematic of a hydraulic system according to an embodiment of the present invention.

According to another embodiment shown in FIG. 1*g*, the hydraulic system again comprises a single prime mover or motor 800 adapted to drive a common shaft 801, similar to the embodiment of FIG. 1*a*. Again, identical parts of the embodiment shown in FIG. 1*g*, are labeled with identical reference numbers. In contrast to the embodiment of FIG. 1*a*, the embodiment of FIG. 1*g* shows variable ratio mechanisms 840, 850 arranged between the common drive shaft 801 and the first or second pump 122, 222 respectively. The variable ratio mechanism 840 connects a drive shaft 841 of the first pump 122 to the common drive shaft 801 of the motor 800. A second variable ratio mechanism 850 connects a second drive shaft 851 of the second pump 222 to the common shaft 801. The variable ratio mechanisms 840 and 850 are adapted to convert the revolution speed of the common drive shaft 801 into a revolution speed of the first and second drive shaft 841, 851 desired to drive the first or second pumps 122, 222 respectively. As such, the variable ratio mechanisms 840, 850 can have any commonly available form, such as gearing, belt or chain mechanisms. Similar to the embodiment of FIG. 1*f*, it is thus not required to provide variable displacement pumps, such as swash plate pumps, and hence the first and second pumps 122, 222 are illustrated as fixed displacement pumps. Of course, it will be appreciated that variable displacement pumps could still be implemented as the first and second pumps.

Figure 2:
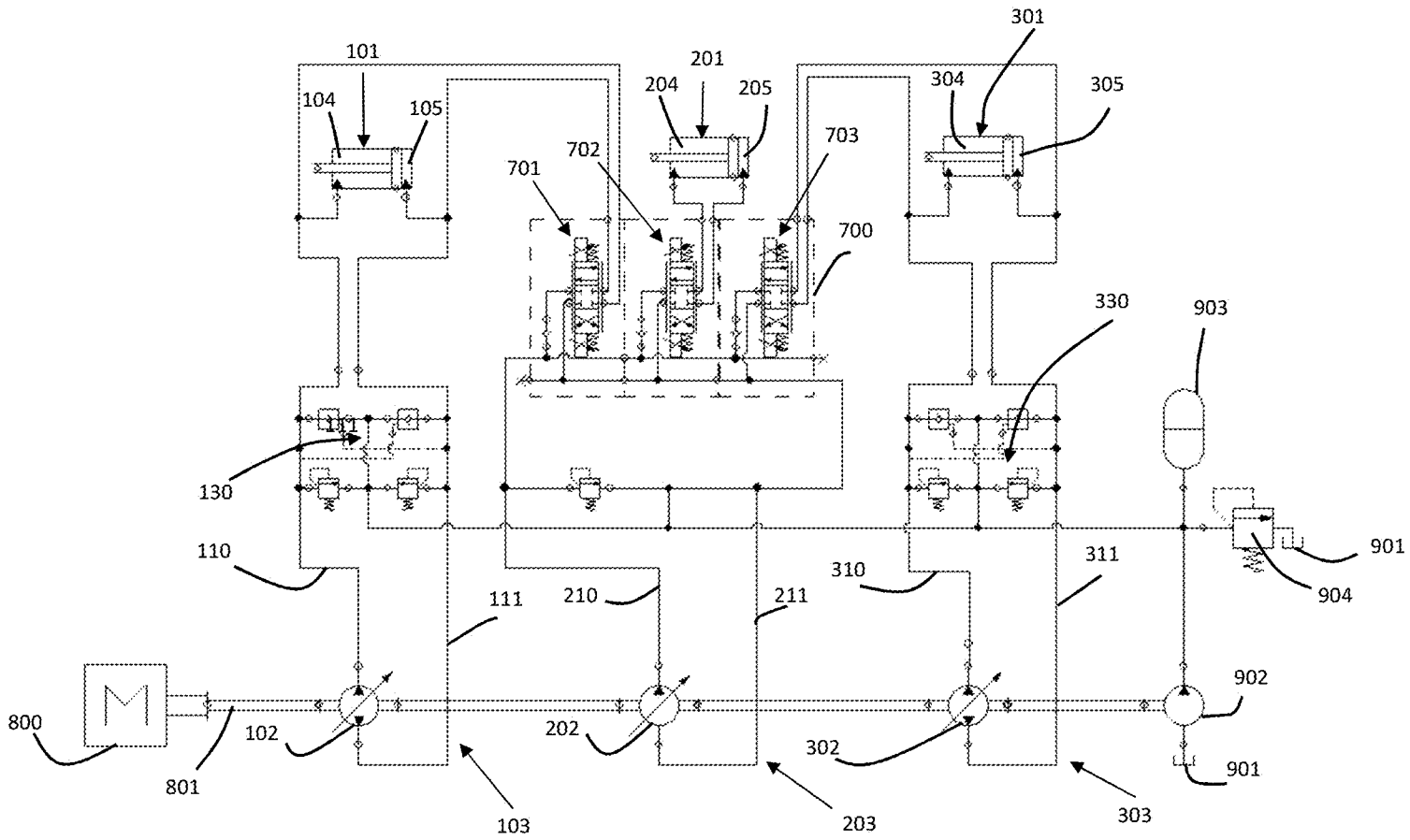
FIG. 2 shows a schematic of a hydraulic system according to a sixth embodiment of the present invention.

Another embodiment of the hydraulic system according to the present invention is shown in FIG. 2. The embodiment of FIG. 2 mostly corresponds to the embodiment of FIG. 1*a* and corresponding parts are labeled with identical reference signs. As can be derived from FIG. 2, this embodiment further comprises a third actuator 301 connected to a third pump 302 in a third closed loop circuit 303, and a third control valve 703.

The third actuator 301 shown in FIG. 2 is again depicted as a linear actuator (particularly a hydraulic cylinder). The third actuator 301 may be used to move the dipper or arm of an excavator. The third actuator 301 is connected to a third pump 302 in a closed loop circuit 303. The third circuit 303 is substantially identical to the first circuit 103 and corresponding parts are labeled with reference numbers corresponding to the first circuit and increased by "200". Similar to the first circuit 102, the second pump 202 can be connected to the third circuit 303 via a third control valve 703 of the valve arrangement 700. As such, the second pump 202 can also be used to assist the movement of the third actuator 301, if the third pump 302 is not sufficient under high speed conditions, i.e. to achieve a predetermined minimal cycle time for the third actuator.

Figure 6:
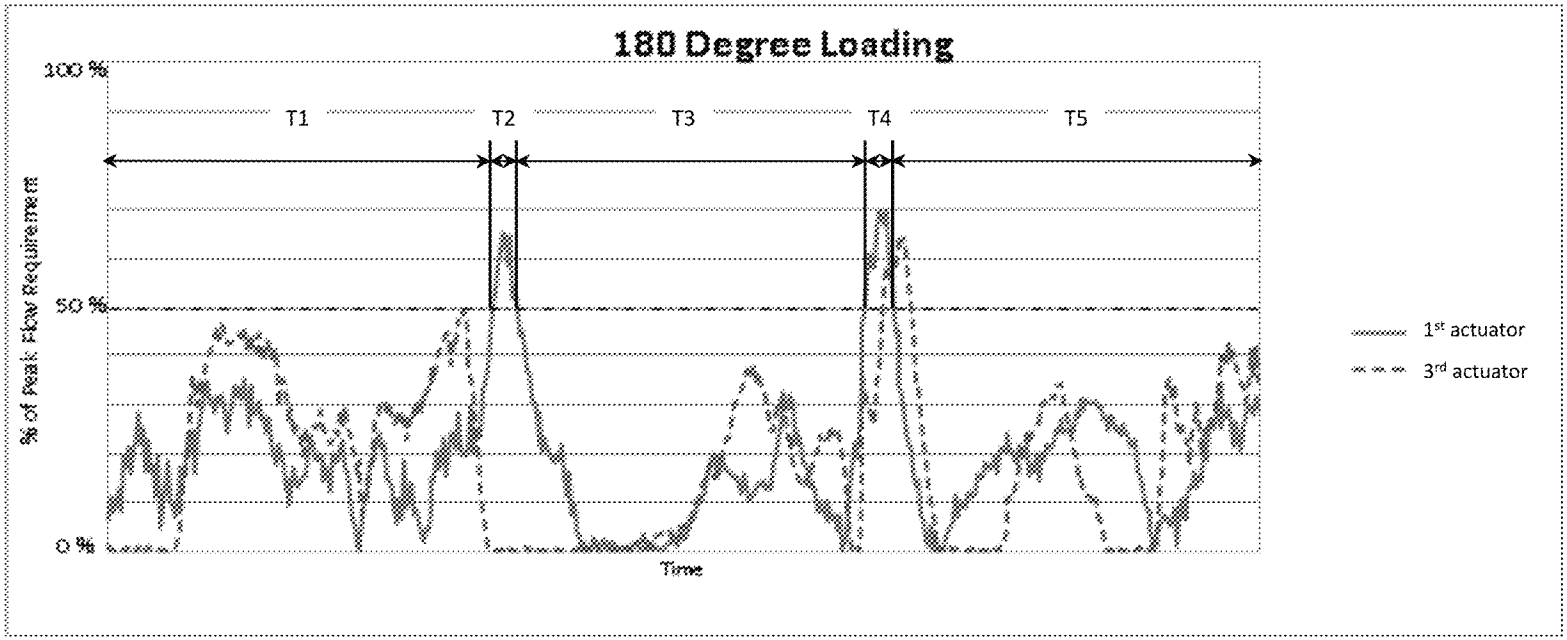
FIG. 6 shows the flow rate requirements of the first and second actuator during a typical duty cycle.

A typical duty cycle of the first and third actuators 101, 301 is shown in FIG. 6. In particular, FIG. 6 shows a duty cycle of an excavator performing a 180 degree loading process. In this example, the first actuator is a boom actuator, whereas the third actuator is an arm/dipper actuator of the excavator. The chart shows the flow requirements of the first and third actuators 101, 301 at different times during the 180 degree loading duty cycle. The solid line represents the flow provided to the first actuator 101, whereas the dashed line refers to the flow provided to the third actuator 301. It will be appreciated by the skilled person that different flow rates are required at different times of the duty cycle. In this particular example, the flow rates required by the first actuator (solid line in FIG. 6) shows two distinct peaks, while for most of the duty cycle, the flow requirements are relatively low. A very similar behavior is shown for the third actuator (dashed line in FIG. 6), which only comprises a single distinct peak.

In particular, the chart of FIG. 6 shows a percentage of the peak flow required by the first and second actuators at any point during the 180 degree loading duty cycle. It should be understood that the 100% horizontal line refers to a peak flow that can be provided to the first or third actuators respectively by combining the fluid flows of the first and second or third and second pumps respectively. As such, the 100% relates to the peak flow rate required to achieve the minimal cycle time as defined hereinbefore.

Evidently, the first and third actuators 101, 301 only require less than 50% of the peak flow rate during most of the duty cycle shown in FIG. 6. As mentioned previously, the first and third pumps 102, 302 can be sized such that their maximum output flow equals 25 to 75%, more preferably 45 to 55%, of the peak flow rate necessary to drive the first actuator at said minimal cycle time. If, as an example only, the maximum fluid output rate of the first and third pump 102, 302 equals 50% of the peak flow rate required to actuate the first and third actuators 101, 301 at a speed sufficient to obtain the minimal cycle time, then any fluid flow requirement below the 50% horizontal line shown in FIG. 6 can be provided by only using the first or third pump 102, 302.

With particular reference to the graph of the first actuator (solid line), this means that during time intervals T1, T3, and T5 shown in FIG. 6, the first actuator can be supplied exclusively with fluid flow from the first pump 102, without the need of extra fluid flow from the second pump 202. Only during time intervals T2 and T4, that is when the first actuator is moved at higher speeds (i.e. higher flow rates and shorter cycle times are required), is assistance needed from the second pump 202. In other words, the fluid flow of the first pump 102 is assisted by fluid flow from the second pump 202 only during intervals T2 and T4. It should be understood that the duty cycle shown in FIG. 6 only refers to a typical 180 degree loading cycle, and thus other duty cycles may have substantially higher or lower flow requirements. However, it has generally been found that peak flow in the respective actuators is only rarely requested by the operator, and thus most of the duty cycle is performed at flow rates relating to 25 to 75% of the peak flow. Accordingly, sizing the first and third pumps to produce a maximum output flow, which relates to 25 to 75% of the peak flow was found to increase the energy efficiency of the system significantly.

While the embodiment of FIG. 2 shows a motor 800 and spool valves 701, 702, 703 equivalent to FIG. 1*a*, it will be appreciated that the alternative valve arrangements and prime movers shown in FIGS. 1*b* to 1*g* could also be utilized in the hydraulic system shown in FIG. 2.

Figure 3:
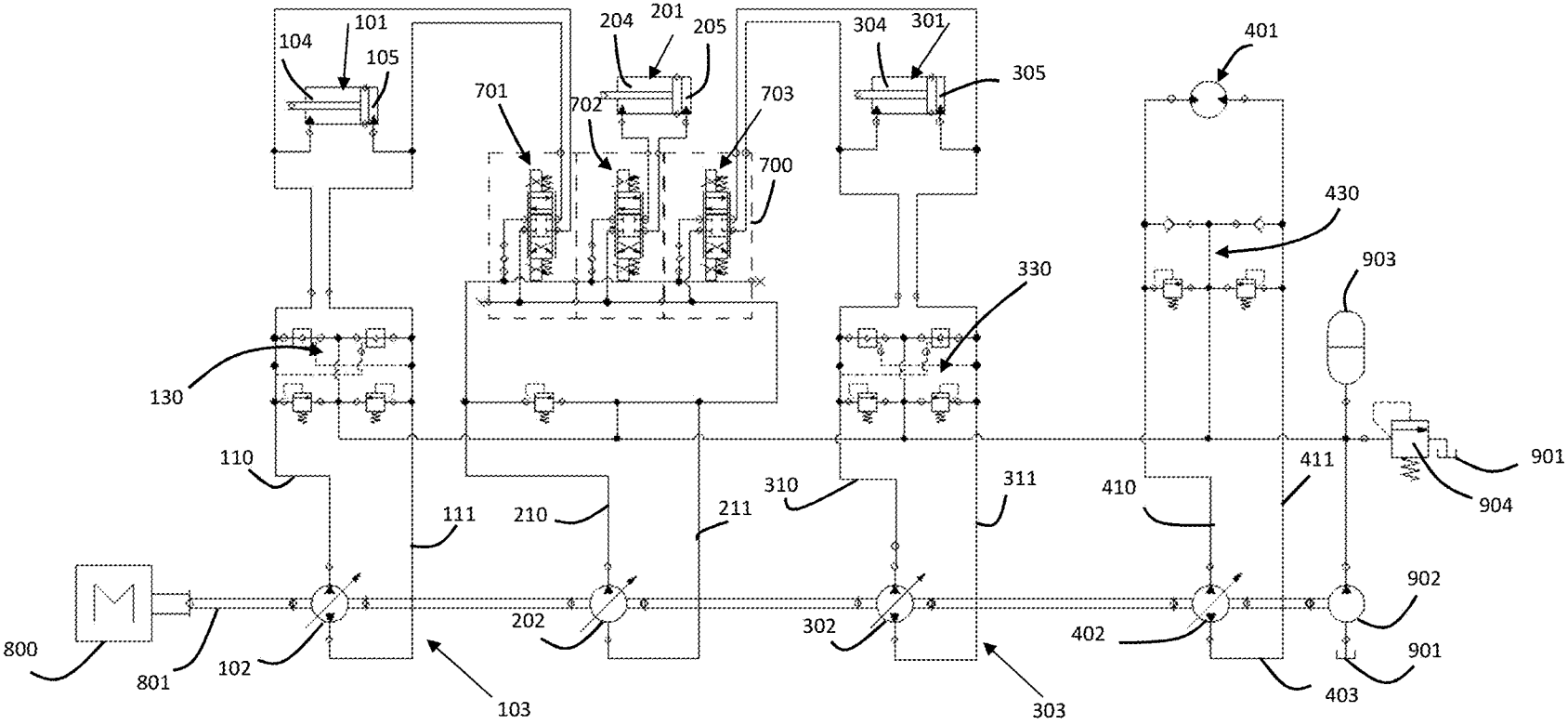
FIG. 3 shows a schematic of a hydraulic system according to a seventh embodiment of the present invention.

Another embodiment of the present invention is shown in FIG. 3. FIG. 3 mostly corresponds to the embodiment shown in FIG. 2 and corresponding parts are labeled with identical reference signs.

The hydraulic system shown in FIG. 3 further comprises a fourth actuator 401, which is connected to a fourth variable displacement pump 402 in a fourth closed loop circuit 403. The fourth actuator 401 may be a rotary actuator, such as a slew motor that can be used to slew the excavator about a vertical axis. The fourth pump 402 of this embodiment is a bi-directional variable displacement pump which is connected to first and second inlet ports of the fourth actuator 401 via first and second fluid lines 410, 411. As can be derived from FIG. 3, the fourth circuit 403 is not connected to any of the first, second and third circuits 103, 203, and 303. However, it is also feasible to arrange the second pump 202 of the second circuit 203 connectable to the fourth actuator 401 via valve arrangement 700.

Figure 4:
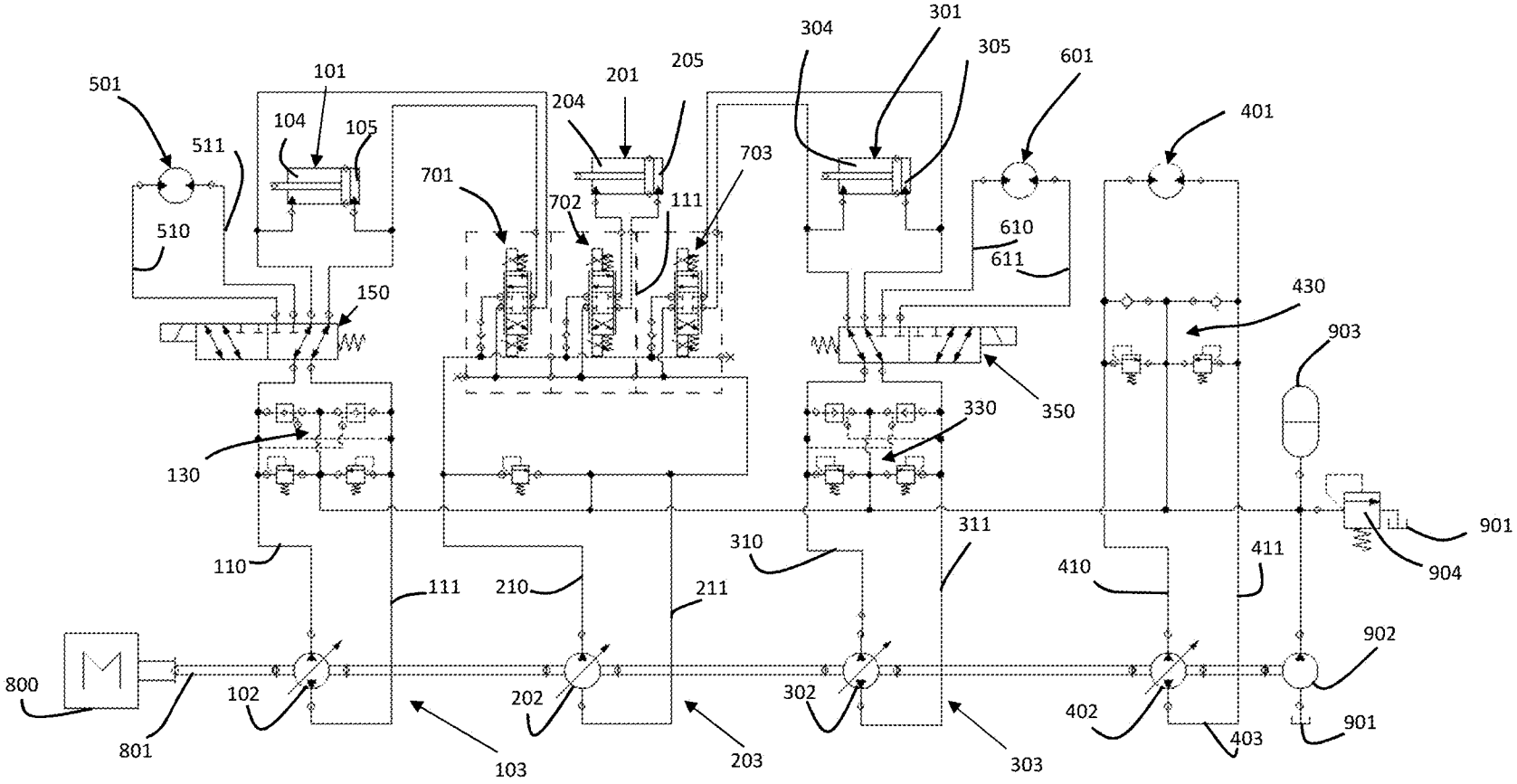
FIG. 4 shows a schematic of a hydraulic system according to an eighth embodiment of the present invention.

As depicted in another embodiment in FIG. 4, the first and third pumps 102, 302 can further be connectable to fifth and sixth actuators 501, 601. In more detail, the first pump 102 can be connected to inlet ports of the fifth actuator 501 via third and fourth fluid lines 510, 511. The connection between the first pump 102 and the fifth actuator 501 may be shut off by diverter valve 150, when the first actuator is in use. Similarly, the diverter valve 150 may be used to shut off the connection between the first pump 102 and the first actuator 101, when the first pump is used to drive the fifth actuator. The fifth actuator 501 may be a rotary actuator, which is used as a travel motor for one of the tracks of the excavator (i.e. left track). Accordingly, the first pump 102 is not only configured to supply the first actuator 101 with pressurized fluids, but can also supply the fifth actuator 501 sequentially to drive the left track of the excavator.

When the first pump 102 is connected to the fifth actuator 501 via the diverter valve 150 (state not shown), the first actuator 101 is shut off from the first pump 102. Yet, it is still feasible to drive the first actuator 101 via the second pump 202 when the first pump 102 is used to drive the fifth actuator 501. As such, the system of FIG. 4 can be used to drive the fifth actuator 501 by means of pump 102 and, at the same time, activate the linear first actuator 101 by means of the second pump 202, which is connected to the first actuator 101 via the first control valve 701.

The third pump 302 is, in turn, connectable to the sixth actuator 601 via third and fourth fluid lines 610, 611 and diverter valve 350. Accordingly, the third pump 302 can be used to sequentially provide the third actuator 301 and the sixth actuator 601 with pressurized fluid. The sixth actuator 601 is configured as a rotary actuator, such as a travel motor for driving the remaining track of the excavator (i.e. right track). Similar to the first actuator 101, the third actuator 301 can be actuated at the same time as the sixth actuator 601 by connecting the second pump 202 to the third actuator 301.

In conclusion, when tracking the excavator via the fifth and sixth actuator 501, 601, the first and second pump 102, 302 of the embodiment shown in FIG. 4 are exclusively used for tracking purposes. If the first, second or third actuators 101, 201, 301 shall be used during tracking, the respective fluid flow is exclusively provided by second pump 202 via valve arrangement 700.

Figure 5:
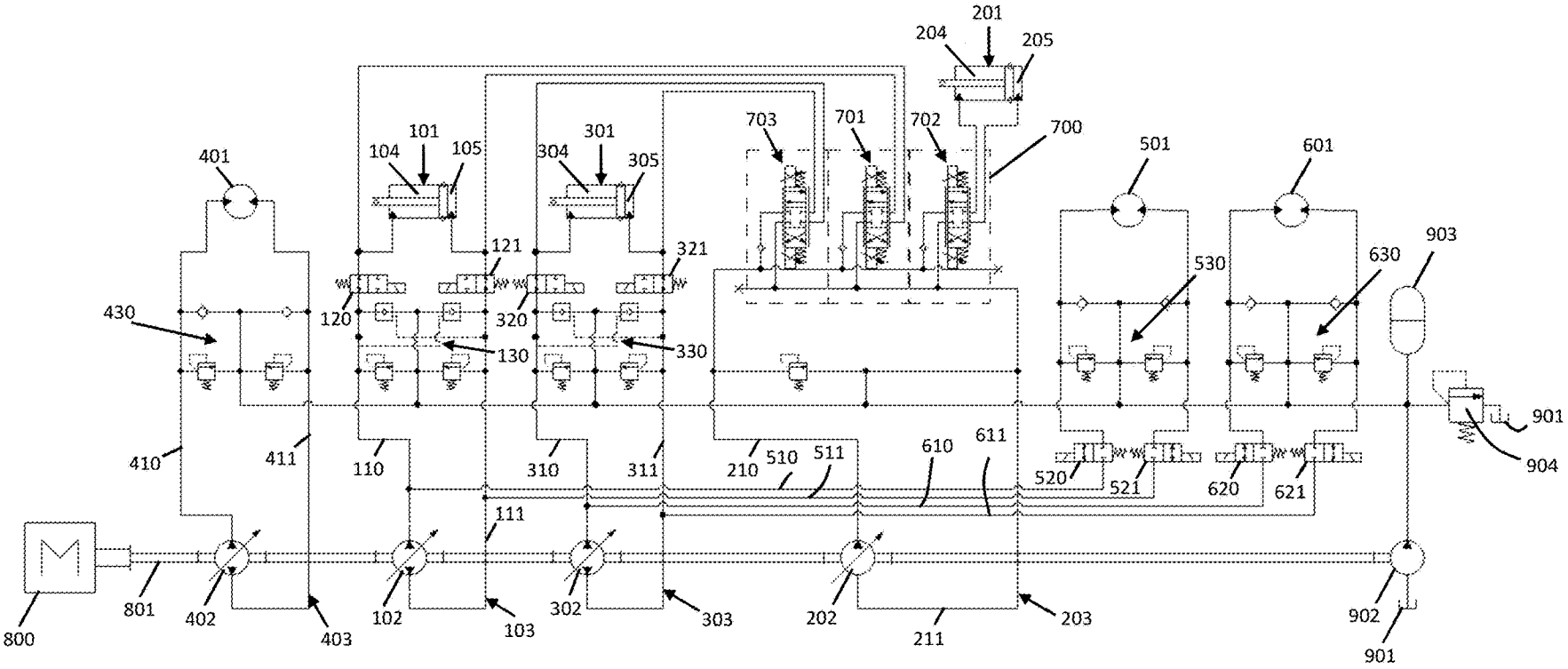
FIG. 5 shows a schematic of a hydraulic system according to a ninth embodiment of the present invention.

The embodiment of FIG. 5 is very similar to the embodiment of FIG. 4. Corresponding parts in this embodiment have been labeled with the same reference numbers as in FIG. 4. As can be seen, the first circuit 110 according to this embodiment comprises first and second on/off valves 120, 121. The first on/off valve 120 selectively connects the first outlet port of the first pump 102 with the first chamber 104 of the first actuator 101 via first fluid line 110. The second on/off valve of the first circuit 103 connects the second outlet port of the first pump 102 with a second chamber 105 via the second fluid line 111 of the first circuit 103. The first pump 102 is further connected to the fifth actuator 501 via third and fourth on/off valves 520, 521. In particular, a first fluid port of the first pump 102 can be connected to the fifth actuator 501 via a third fluid line 510 if the third on/off valve 520 is in its open state. The second fluid port of pump 102 can be connected to the fifth actuator via fourth fluid line 511 if the fourth on/off valve 521 is opened. It will be appreciated, that the third and fourth on/off valves 520, 521 are preferably closed when the first and second on/off valves 120, 121 are opened and vice versa.

Similar to the embodiment of FIG. 4, the first actuator 101 can be driven by the second pump 202 when the first pump 102 is used for tracking, i.e. actuating the fifth actuator 501. It will be appreciated that the first and second on/off valves 320/321 of the third circuit 303 function in an identical manner to the first and second on/off valves 120, 121 of the first circuit 103. The same is true for the third and fourth on/off valves 620, 621, which correspond to third and fourth on/off valves 520, 521. In other words, if the first and second on/off valves 320/321 of the third circuit 303 are closed, the third pump 302 can be used to drive the sixth actuator 601, by connecting the third pump 302 to the sixth actuator 601 via third and fourth on/off valves 620, 621.

In the embodiment shown in FIGS. 1*a*, 1*b*, 1*c*, 1*d*, 1*e*, 2, 3, 4 and 5, the first, second, third and fourth pumps 102, 202, 302, 402 are driven by a common drive shaft 801 which connects each of the pumps 102, 202, 302, 402 to a single prime mover or drive motor 800, such as a combustion engine or electric motor. The drive motor 800 is also connected to a charge pump 902 via the common drive shaft 801. As mentioned previously in connection with FIGS. 1*f* and 1*g*, the invention is not limited to this particular drive arrangement. For example, any prime mover could be used to drive the pumps and the pumps maybe connected to a plurality of prime movers via a plurality of drive shafts, as shown in FIG. 1*f*. Alternatively, the pumps could be connected to a common drive shaft via variable ratio mechanisms as depicted in FIG. 1*g*.

The charge pump 902 is configured to maintain the system pressure of the hydraulic system by supplying pressurized fluid from a hydraulic reservoir 901 to the fluid circuits. To this end, each of the fluid circuits comprises an anti-cavitation arrangement 130, 230, 330, 430, 530, 630 with check valves that allow the charge pump 902 to maintain a slightly elevated pressure. Each of the anti-cavitation systems 130, 230, 330, 430, 530 and 630 further comprises pressure relief valves to avoid high pressure damages during operation of the respective fluid circuits.

The invention is not restricted to the particular embodiments described with reference to the embodiment shown in the attached illustration. In particular, the first, second, third and fourth pumps 102, 202, 302, 402 may be fixed or variable displacement, uni- or bi-directional and/or reversible/non-reversible pumps. Similarly the first, second, third, fourth, fifth and sixth actuators 101, 201, 301, 401, 501, 601 are not restricted to the particular applications shown but may be any type of actuator suitable for moving respective parts of a construction machine.

The following numbered clauses, which are not the claims, refer to examples of the hydraulic system and construction machinery described hereinbefore.

1. A hydraulic system comprising:

a first actuator;

a first variable displacement pump fluidly connected to the first actuator via a first circuit and adapted to drive the first actuator;

a second actuator;

a second pump fluidly connectable to the second actuator via a second circuit and adapted to drive the second actuator, wherein the second pump is fluidly connectable to the first actuator via a first control valve, and wherein the second pump is fluidly connectable to the second actuator via a second control valve.

2. The hydraulic system of clause 1, wherein the first circuit is a closed loop circuit.

3. The hydraulic system of clause 1 or 2, wherein the second circuit is a closed loop circuit.

4. The hydraulic system of any of clauses 1 to 3, wherein the second pump is a variable displacement pump.

5. The hydraulic system of any of clauses 1 to 4, wherein the first pump is directly connected or connectable to the first actuator, and wherein the first control valve is a first proportional control valve adapted to variably restrict a fluid flow from the second pump provided to the first actuator.

6. The hydraulic system of clause 5, wherein the first proportional control valve is a directional, proportional spool valve, preferably a 4/3 spool valve.

7. The hydraulic system of clause 5, wherein the first proportional control valve is an independent metering valve.

8. The hydraulic system of clause 7, wherein the independent metering valve is connected to a first chamber of the first actuator via a first fluid line and to a second chamber of the first actuator via a second fluid line, wherein a first pressure sensor is provided in the first fluid line and a second pressure sensor is provided in the second fluid line.

9. The hydraulic system of clause 8, wherein the hydraulic system comprises a control unit adapted to receive pressure information from the first and second pressure sensors, and wherein the control unit is configured to control the independent metering valve to connect one of the first or second chamber to a fluid return line, depending on the pressure information.

10. The hydraulic system of any of clauses 1 to 9, wherein the second control valve is a second proportional control valve adapted to variably restrict the second fluid pressure of the second pump provided to the second actuator.

11. The hydraulic system of clause 10, wherein the second proportional control valve is a directional, proportional spool valve, preferably a 4/3 spool valve.

12. The hydraulic system of any of clauses 1 to 11, further comprising a third actuator and a third pump connectable to the third actuator via a third circuit and adapted to drive the third actuator.

13. The hydraulic system of clause 12, wherein the second pump is fluidly connectable to the third actuator via a third control valve.

14. The hydraulic system of clause 13, wherein the third pump is directly connected or connectable to the third actuator, and wherein the system comprises a third proportional control valve adapted to variably restrict a fluid flow from the second pump provided to the third actuator.

15. The hydraulic system of clause 14, wherein the third proportional control valve is a directional, proportional spool valve, preferably a 4/3 spool valve.

16. The hydraulic system of any of clauses 1 to 15, wherein the first pump is configured as a bidirectional variable displacement pump and the second pump is configured as a unidirectional pump, and wherein the first and second control valves are directional control valves.

17. The hydraulic system of clause 16, wherein the first pump comprises a first port connected or selectively connectable to a first chamber of the first actuator and a second port connected or selectively connectable to a second chamber of the first actuator.

18. The hydraulic system of clause 16, wherein the second pump comprises a first port selectively connectable to the first or second chamber of the first actuator via the first control valve and a second port selectively connectable to the first or second chamber of the first actuator via the first control valve.

19. The hydraulic system of clause 15 or 16, wherein the second pump is arranged to selectively act as a charge pump maintaining the hydraulic system at an elevated fluid pressure.

20. The hydraulic system of clause 19, wherein the second circuit is an open circuit.

21. The hydraulic system of clause 20, wherein the second pump comprises a first port selectively connectable to the first or second chamber of the first actuator via the first control valve and a second port connected to a hydraulic fluid reservoir.

22. The hydraulic system of clause 21, wherein the first port of the second pump is connected to the hydraulic fluid reservoir via a bypass-valve, preferably a variable pressure relief valve.

23. The hydraulic system of any of clauses 16 to 22, further comprising a third actuator and a third pump connectable to the third actuator via a third closed loop circuit and adapted to drive the third actuator.

24. The hydraulic system of clause 23, wherein the third pump comprises a first port connected or selectively connectable to a first chamber of the third actuator and a second port selectively connectable to a second chamber of the third actuator.

25. The hydraulic system of clause 24, wherein the second pump comprises a first port selectively connectable to the first or second chamber of the third actuator via a third control valve and a second port selectively connectable to the first or second chamber of the third actuator via the third control valve.

26. The hydraulic system of any of clauses 16 to 25, wherein the second pump comprises a first port selectively connectable to a first or second chamber of the second actuator via the second control valve and a second port selectively connectable to the first or second chamber of the second actuator via the second control valve.

27. The hydraulic system of any of clauses 16 to 26, wherein the first and second pumps are connected to a single prime mover via a common drive shaft.

28. The hydraulic system of any of clauses 23 to 25 and clause 27, wherein the third pump is connected to the prime mover via the common drive shaft.

29. The hydraulic system of clause 27 or 28, wherein the prime mover is a single speed motor or an internal combustion engine.

30. The hydraulic system of any of clauses 1 to 29, wherein the first pump is sized such that a maximum output flow rate of the first pump equals 25% to 75%, preferably 40% to 60%, more preferably 45% to 55%, of a peak flow rate necessary to drive the first actuator at a predetermined minimal cycle time.

31. The hydraulic system of clause 30, wherein the hydraulic system comprises a controller connected to the first control valve and adapted to control the first control valve to selectively connect the second pump to the first circuit, if the maximum fluid output flow of the first pump is not sufficient to move the first actuator at a speed necessary to obtain the minimal cycle time for the first actuator.

32. The hydraulic system of Clause 30 or 31, wherein the first control valve is a proportional control valve.

33. The hydraulic system of Clause 32, wherein the proportional control valve is a directional spool valve.

34. The hydraulic system of any of clauses 30 to 33, further comprising a third actuator and a third pump connectable to the third actuator via a third circuit and adapted to drive the third actuator.

35. The hydraulic system of clause 34, wherein the third pump is sized such that a maximum output flow rate of the third pump equals 25% to 75%, preferably 40% to 60%, more preferably 45% to 55%, of a peak flow rate necessary to drive the third actuator at a predetermined minimal cycle time.

36. The hydraulic system of clause 35, wherein the second pump is fluidly connectable to the third actuator via a third control valve.

37. The hydraulic system of clause 36, wherein the hydraulic system comprises a controller connected to the third control valve and adapted to control the third control valve to selectively connect the second pump to the third circuit, if the maximum fluid output flow of the third pump is not sufficient to move the third actuator at a speed necessary to obtain the minimal cycle time for the third actuator.

38. The hydraulic system of any of clauses 1 to 37, wherein the first pump is sized to exhibit a maximum output flow which is 50% to 150%, preferably 75% to 125%, more preferably 95% to 105%, of a maximum output flow of the second pump.

39. The hydraulic system of any of clauses 1 to 38, wherein the third pump is sized to exhibit a maximum output flow which is 50% to 150%, preferably 75% to 125%, more preferably 95% to 105%, of the maximum output flow of the second pump.

40. The hydraulic system of one of clauses 1 to 39, wherein the first actuator is a linear actuator.

41. The hydraulic system of clause 40, wherein the first actuator is a hydraulic cylinder for displacement of an excavator boom.

42. The hydraulic system of one of clauses 1 to 41, wherein the second actuator is a linear actuator.

43. The hydraulic system of clause 42, wherein the second actuator is a hydraulic cylinder for displacement of an excavator bucket.

44. The hydraulic system of one of clauses 1 to 43, wherein the third actuator is a linear actuator.

45. The hydraulic system of clause 44, wherein the third actuator is a hydraulic cylinder for displacement of an excavator arm.

46. The hydraulic system of any of clauses 1 to 45, further comprising a fourth actuator and a fourth pump connectable to the fourth actuator via a fourth circuit and adapted to drive the fourth actuator.

47. The hydraulic system of clause 46, wherein the fourth actuator is a rotary actuator.

48. The hydraulic system of clauses 46 or 47, wherein the fourth actuator is a hydraulic motor for slewing.

49. The hydraulic system of any of clauses 1 to 48, wherein the system further comprises a fifth actuator, wherein the first pump is selectively connectable to the fifth actuator.

50. The hydraulic system of any of clauses 1 to 49, wherein the system further comprises a sixth actuator, wherein the third pump is selectively connectable to the sixth actuator.

51. A construction machine, comprising the hydraulic system of any of clauses 1 to 50.

The invention claimed is:

1. A hydraulic system comprising:

a first actuator;

a first variable displacement pump fluidly connected to the first actuator via a first circuit and adapted to drive the first actuator;

a second actuator;

a second pump fluidly connectable to the second actuator via a second circuit and adapted to drive the second actuator, wherein the second pump is fluidly connectable to the first actuator via a first control valve, and wherein the second pump is fluidly connectable to the second actuator via a second control valve, wherein the second pump is selectively and simultaneously connectable to the second actuator and to the first actuator to provide a top up fluid flow to assist a fluid flow from the first variable displacement pump, wherein the second pump is also arranged to act as a charge pump maintaining the hydraulic system at an elevated fluid pressure, and wherein the first variable displacement pump is directly connected or connectable to the first actuator, and wherein the first control valve is a first proportional control valve adapted to variably restrict a fluid flow from the second pump provided to the first actuator.

2. The hydraulic system of claim 1, wherein the first circuit is a closed loop circuit.

3. The hydraulic system of claim 1, wherein the second pump is a variable displacement pump.

4. The hydraulic system of claim 1, wherein the second control valve is a second proportional control valve adapted to variably restrict the second fluid pressure of the second pump provided to the second actuator.

5. The hydraulic system of claim 4, wherein the first proportional control valve is a directional, proportional spool valve, and wherein the second proportional control valve is a directional, proportional spool valve.

6. The hydraulic system of claim 4, wherein the first proportional control valve is an independent metering valve and wherein the independent metering valve is connected to a first chamber of the first actuator via a first fluid line and to a second chamber of the first actuator via a second fluid line, wherein a first pressure sensor is provided in the first fluid line and a second pressure sensor is provided in the second fluid line, and wherein the hydraulic system comprises a control unit adapted to receive pressure information from the first and second pressure sensors, and wherein the control unit is configured to control the independent metering valve to connect one of the first or second chamber to a fluid return line, depending on the pressure information.

7. The hydraulic system of claim 1, further comprising a third actuator and a third pump connectable to the third actuator via a third circuit and adapted to drive the third actuator, and wherein the second pump is fluidly connectable to the third actuator via a third control valve.

8. The hydraulic system of claim 7, wherein the third pump is directly connected or connectable to the third actuator, and wherein the system comprises a third proportional control valve adapted to variably restrict a fluid flow from the second pump provided to the third actuator and wherein the third proportional control valve is a directional, proportional spool valve.

9. A hydraulic system comprising:

a first actuator;

a first variable displacement pump fluidly connected to the first actuator via a first circuit and adapted to drive the first actuator;

a second actuator;

a second pump fluidly connectable to the second actuator via a second circuit and adapted to drive the second actuator, wherein the second pump is fluidly connectable to the first actuator via a first control valve and adapted to drive the first actuator, and wherein the second pump is fluidly connectable to the second actuator via a second control valve, and wherein the first variable displacement pump is configured as a bidirectional variable displacement pump and the second pump is configured as a unidirectional pump, and wherein the first and second control valves are directional control valves.

10. The hydraulic system of claim 9, wherein the first variable displacement pump comprises a first port connected or selectively connectable to a first chamber of the first actuator and a second port connected or selectively connectable to a second chamber of the first actuator and wherein the second pump comprises a first port selectively connectable to the first or second chamber of the first actuator via the first control valve and a second port selectively connectable to the first or second chamber of the first actuator via the first control valve.

11. The hydraulic system of claim 9, wherein the second pump is arranged to act as a charge pump maintaining the hydraulic system at an elevated fluid pressure and wherein the second circuit is an open circuit, and wherein the second pump comprises a first port selectively connectable to the first or second chamber of the first actuator via the first control valve and a second port connected to a hydraulic fluid reservoir, and wherein the first port of the second pump is connected to the hydraulic fluid reservoir via a bypass-valve.

12. The hydraulic system of claim 9, further comprising a third actuator and a third pump connectable to the third actuator via a third closed loop circuit and adapted to drive the third actuator, wherein the third pump comprises a first port connected or selectively connectable to a first chamber of the third actuator and a second port selectively connectable to a second chamber of the third actuator, and wherein the second pump comprises a first port selectively connectable to the first or second chamber of the third actuator via a third control valve and a second port selectively connectable to the first or second chamber of the third actuator via the third control valve.

13. The hydraulic system of claim 1, wherein the first variable displacement pump and second pump are connected to a single prime mover via a common drive shaft.

14. A hydraulic system comprising:

a first actuator;

a first variable displacement pump fluidly connected to the first actuator via a first circuit and adapted to drive the first actuator;

a second actuator;

a second pump fluidly connectable to the second actuator via a second circuit and adapted to drive the second actuator, wherein the second pump is fluidly connectable to the first actuator via a first control valve, and wherein the second pump is fluidly connectable to the second actuator via a second control valve, and wherein the first variable displacement pump is sized such that a maximum output flow rate of the first variable displacement pump equals 45% to 55% of a peak flow rate necessary to drive the first actuator at a predetermined minimal cycle time.

15. The hydraulic system of claim 14, wherein the hydraulic system comprises a controller connected to the first control valve and adapted to control the first control valve to selectively connect the second pump to the first circuit, when the maximum fluid output flow of the first variable displacement pump is not sufficient to move the first actuator at a speed necessary to obtain the minimal cycle time for the first actuator.

16. The hydraulic system of claim 14, further comprising a third actuator and a third pump connectable to the third actuator via a third circuit and adapted to drive the third actuator, wherein the third pump is sized such that a maximum output flow rate of the third pump equals 45% to 55% of a peak flow rate necessary to drive the third actuator at a predetermined minimal cycle time.

17. The hydraulic system of claim 14, wherein the second pump is fluidly connectable to the third actuator via a third control valve.

18. The hydraulic system of claim 17, wherein the hydraulic system comprises a controller connected to the third control valve and adapted to control the third control valve to selectively connect the second pump to the third circuit, when the maximum fluid output flow of the third pump is not sufficient to move the third actuator at a speed necessary to obtain the minimal cycle time for the third actuator.

19. The hydraulic system of claim 1, wherein the first variable displacement pump is sized to exhibit a maximum output flow which is 50% to 150% of a maximum output flow of the second pump and/or wherein the third pump is sized to exhibit a maximum output flow which is 50% to 150% of the maximum output flow of the second pump.

20. A construction machine, comprising the hydraulic system of claim 1.

* * * * *